US006663217B2

(12) United States Patent
Otsuka et al.

(10) Patent No.: US 6,663,217 B2
(45) Date of Patent: Dec. 16, 2003

(54) INK JET RECORDING APPARATUS

(75) Inventors: Naoji Otsuka, Kanagawa (JP); Hitoshi Sugimoto, Kanagawa (JP); Takeshi Yazawa, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/956,790

(22) Filed: Sep. 21, 2001

(65) Prior Publication Data

US 2002/0039120 A1 Apr. 4, 2002

(30) Foreign Application Priority Data

Sep. 29, 2000 (JP) ..... 2000-299906

(51) Int. Cl.[7] ..... B41J 2/165
(52) U.S. Cl. ..... 347/29; 347/32; 347/31
(58) Field of Search ..... 347/24, 29, 32, 347/48, 15, 43, 31

(56) References Cited

U.S. PATENT DOCUMENTS

| | | | | |
|---|---|---|---|---|
| 4,565,859 A | | 1/1986 | Murai et al. | 528/365 |
| 5,701,146 A | | 12/1997 | Akiyama et al. | 347/26 |
| 5,896,143 A | | 4/1999 | Matsui et al. | 347/24 |
| 6,123,407 A | * | 9/2000 | Muraki | 347/24 |
| 6,145,956 A | | 11/2000 | Koitabashi et al. | 347/30 |
| 6,179,404 B1 | | 1/2001 | Kawarama et al. | 347/31 |
| 2002/0054186 A1 | * | 5/2002 | Hotomi et al. | 347/43 |

FOREIGN PATENT DOCUMENTS

| | | | | |
|---|---|---|---|---|
| JP | 60-161973 | | 8/1985 | C07D/302/14 |
| JP | 63-221121 | | 9/1988 | C08G/59/02 |
| JP | 64-9216 | | 1/1989 | C08G/59/34 |
| JP | 2-140219 | | 5/1990 | C08G/59/18 |
| JP | 06191061 A | * | 7/1994 | B41J/2/21 |

OTHER PUBLICATIONS

J.V. Crivello et al, "New Photoinitiators for Cationic Polymerization", J. Polymer Sci.: Symposium No. 56, 383–395 (1976).

U.S. application No. 09/901,196, filed Jul. 10, 2001.

* cited by examiner

*Primary Examiner*—Judy Nguyen
*Assistant Examiner*—Alfred E Dudding
(74) *Attorney, Agent, or Firm*—Fitzpatrick, Cella, Harper & Scinto

(57) ABSTRACT

An ink jet recording apparatus comprises an ink jet recording head with a plurality of recording elements for generating energy for discharging ink, a plurality of ink flow paths, a plurality of ink discharge ports for discharging ink, and a plurality of recording element substrates, and a cap member for capping the discharge ports. The plurality of recording element substrates, the thickness of one being different from that of the others, are arranged adjacent to each other on a substantially even flat plane, and the cap member is made capable of capping the discharge ports of the plurality of recording element bases plates altogether on the substantially even flat plane.

15 Claims, 17 Drawing Sheets

INK JET RECORDING APPARATUS

BACKGROUND OF THE INVENTION

1. Field of the Invention

The present invention relates to an ink jet recording apparatus that performs a recording operation by discharging recording liquid, such as ink, from the discharge ports for the formation of liquid droplets.

The present invention is applicable to such an apparatus as a printer for recording on paper, thread, fiber, cloth, leather, plastics, glass, woods, ceramics, and other recording mediums, a copying machine, a facsimile equipment provided with communication systems, and a word processor having printing unit. Further, the invention is applicable to an industrial recording system combined complexly with various kinds of processing apparatuses. Here, the term "recording" referred to in the specification hereof not only means the provision of meaningful images for a recording medium, such as characters and graphics, but also, it means the provision of such meaningless images as patterns, among some others.

2. Related Background Art

The ink jet recording apparatus is a recording apparatus of the so-called non-impact recording type capable of recording on various kinds of recording mediums at high speed, which is characterized in that the apparatus generates almost no noises during the recording operation. With such advantages, the ink jet recording apparatus is widely adopted as the one that bears recording mechanism for a printer, a copying machine, a facsimile equipment, a word process, or the like.

As the typical ink discharge method for the recording head mounted on an ink jet recording apparatus of the kind, there has been known the one which uses electromechanical converting devices, such as piezoelectric elements, the one that uses the irradiation of laser or some other electromagnetic waves to generate heat for discharging ink droplets by the action of heat thus generated, or the one that uses the electrothermal converting devices having heat generating resistive elements to give heat to ink for discharging ink droplets by the action of film boiling. The ink jet recording head that uses the electrothermal converting devices provides each electrothermal converting device for the interior of each recording liquid chamber, and then, supplies electric pulses serving as recording signals to each of them, respectively, in order to generate heat for the provision of thermal energy for ink. Thus, with the utilization of bubbling pressure exerted when recording liquid is bubbled (at the time of film boiling), which creates the phasic changes of the recording liquid then. In this way, recording is made on a recording medium. The apparatus is generally provided with ink jet recording nozzles for discharging ink droplets, and the supply system that supplies ink to the nozzles.

The recording apparatus which is provided with an ink jet recording head of the kind is capable of outputting characters and images in high quality at low costs.

With such advantages as to output color prints at lower costs, this recording apparatus of the so-called BJ type has conventionally been in wide use. The recording apparatus is based on the discharge principle of bubble jet type proposed by Canon Kabushiki Kaisha, the applicant hereof, where liquid droplets are discharged along the formation of each bubble (generation, growth, defoaming (debubling), and extinction). This recording apparatus uses the bubble jet method adopted commonly for each of the recording element substrates that discharges black ink as black liquid, and cyan, magenta, and yellow ink as liquid of respective colors.

Here, it is required more, in general, to provide images in a higher quality, and to need such requirement, the number of discharge ports for each recording element substrate tends to increase from 64 ports to 128 ports, 256 ports, and so on, and arranged in a higher density in terms of the "dpi." which stands for the number of discharge ports per inch, such as 300 dpi, 600 dpi, and so on. The heat generating element, which serves as the electrothermal converting device to be arranged for the discharge ports, responds to the pulse driving of several psec order to 10 $\mu$sec order, and forms bubbles by means of film boiling. Then, this element can be driven at high frequency to enable the high speed printing and the formation of high quality images to be attained. In recent years, therefore, the number of heat generating elements, which should be driven per unit time, tends to be increased.

For the conventional ink jet recording head, a plurality of ink discharge ports are incorporated on the same flat plane of one silicon substrate by use of the semiconductor manufacturing technology and technique. As a result, the front face (discharge port surface) of the discharge formation member is formed almost flat uniformly on the silicon substrate. With the formation of such discharge port formation member on the flat surface of the silicon substrate, a chip, which serves as the recording element substrate, is completed. The chip is adhesively bonded or bonded to the structural member under pressure for fixation. At the same time, a member provided with ink flow paths is bonded in order to supply ink. Further, the wiring member that supplies electric signals is arranged in a specific direction around the recording element substrate.

When a color recording is made by this ink jet recording head, color ink (usually, three kinds of cyan, magenta, and yellow) and black ink are discharged, but it is sometimes preferable to make the discharge amounts and other conditions different for color ink and black ink. In other words, in order to attain recording in colors in a high quality at the same level as that of a silver salt photography, it is necessary to make dots small enough so as not to be seen on a recording sheet (in a granular sense). Thus, it is preferable to make the liquid droplet of color ink extremely fine. As to black ink, too, it is preferable to form small dots on the recording sheet by the provision of fine liquid droplets in consideration of the enhancement of resolution and sharpness of characters. However, there are often the cases where a designated area should be solidly painted in addition to characters and the like to be recorded, that is, the so-called solid printing is made often. If the solid printing should be made by discharges of finer liquid droplets, the discharge frequency becomes higher inevitably, requiring a longer recording time. It is therefore preferable to make arrangement so that black ink can be discharged in larger liquid droplets than those of the other color ink.

When the discharge amounts of black ink and other color ink are made different like this, it is conceivable that the recording heads should be structured separately each individually for use of black ink and that of other color ink. However, when a recording apparatus is completed by installing a plurality of individual recording heads on the recording apparatus, the distance between the element substrates becomes greater in the main scanning direction inevitably, leading to a problem that the width of the carriage main scan becomes larger to the extent that the entire width of the separated recording element substrates becomes greater. In this respect, if the recording element substrate for use of color ink and the recording element substrate for use of black ink are arranged closely to make them a single recording head instead of structuring plural recording heads to be separated each individually, it presents new and effective means. In this case, the recording element substrate for use of color ink and the recording element substrate for use of black ink should be produced by use of different recording element substrates. Particularly, when the discharge amounts must be made different for color ink and black ink, it is inevitable to produce the substrates separately, because the diameter of each discharge port is often made different per recording element substrate, and the distance between the discharge heater (electrothermal converting device) and the discharge port becomes different, too, and the resultant thickness of recording element substrates becomes different inevitable.

For the usual ink jet recording apparatus, a cap member is provided to cover the front side of discharge ports in order to prevent ink from being evaporated and solidified around the discharge ports when the apparatus is not in use or to receive ink when predischarges are performed for removing mixed particles and the like together with ink bubbles, before recording. For the conventional recording apparatus, the main current of structure in this respect is that either capping is arranged on the discharge port surface or on the wiring member that surrounds a single recording substrate. For the ink jet recording apparatus which is structured to use piezoelectric elements, too, it is the main current to structure capping on the entire surface of a uniformly flat orifice plate. This is because the cap member must be in close contact with the uniformly flat surface or the smoothly continuous flat surface in order to obtain the anticipated capping effect by covering the circumference of discharge ports by use of the cap member.

As shown in FIG. 27 and FIG. 28, the main current of the structure of the conventional ink jet recording head is the one in which plural recording element substrates 200 and 201 are adhesively bonded to each of the correspondingly separated structural members 202 and 203, respectively. The structure of the recording head provided with plural recording element substrates 200 and 201, which are capable of obtaining different discharge amounts, makes it inevitable to position the flat surfaces where each of the recording element substrates 200 and 201 is installed, respectively, to be considerably apart from each other. As a result, capping cannot be implemented by use of one and the same cap. The structure should become such that capping is effectuated by use of each of the individual cap members 204 and 205. There is no consideration at all, either, as to the difference in the thickness of recording element substrates 200 and 201, which is brought about by the difference in the discharge amount. This is also another one of reasons here.

SUMMARY OF THE INVENTION

One of the objects of the present invention is to provide an ink jet recording apparatus to be made smaller at lower costs by using an integrated cap member to cap recording heads on a substantially even flat plane simultaneously, while being provided with a plurality of recording element substrates having different amounts of ink discharges, respectively.

The other object of the present invention is to provide an ink jet recording apparatus which comprises an ink jet recording head provided with a plurality of recording elements for generating energy to be utilized for discharging ink, a plurality of flow paths for retaining ink to receive the energy, a plurality of ink discharge ports for discharging ink, and a plurality of recording element substrates, and a cap member for capping the discharge ports of the ink jet recording head, and in which the plurality of recording element substrates having the thickness of one recording element substrate thereof being different from that of the other recording element substrate are arranged adjacent to each other on a substantially even flat plane, and the cap member is capable of capping the discharge ports of the plurality of recording element bases plates altogether on the essentially uniform flat plane.

With the structure thus arranged, it becomes possible to simply cap the ink jet recording heads having a plurality of recording element bases plates which are different in thickness and discharge characteristics. As a result, the recording apparatus can be made significantly smaller at lower costs. In other words, for the serial printer where an ink jet recording head scans, the interval between recording element substrates can be made as close as possible in the main scanning direction, hence making the scanning width smaller in the main scanning direction. Further, when the capping mechanism and others are arranged in the non-recording area in the main scanning direction, the smaller the interval between a plurality of recording element substrates, the smaller becomes the width of the capping mechanism and others. This presents an extremely significant advantage for the ultra-small portable printer or the like.

The cap member may be the one that performs capping with the ribs thereof being closely in contact with the flat plane. In this case, the ribs of the cap member forms a single capping space being surrounded thereby so that capping may be performed by positioning the discharge ports of the plurality of recording element substrates in the single capping space or a plurality of capping spaces are formed by being surrounded by the ribs of the cap member, and the discharge ports of the recording element substrates are positioned respectively in the plurality of capping spaces to perform capping. Further, in this case, at least a part of the ribs positioned at the boundary of the plurality of capping spaces may be made to be a contour line commonly possessed by the plurality of capping spaces.

It is preferable to make the distance between the recording element and the discharge port on the recording substrate having black liquid being supplied thereto as ink is relatively long, and the distance between the recording element and the discharge port on the recording substrate having color liquid being supplied thereto as ink relatively short. Then, it is preferable to make the discharge amount of liquid discharged from the discharge port on the recording element substrate having black liquid being supplied thereto as ink relatively large, and the discharge amount of liquid discharged from the discharge port on the recording element substrate having color liquid being supplied thereto as ink relatively small.

With the structure thus arranged, it becomes possible to perform a solid printing at a high speed by discharging large liquid droplets of black recording liquid, while it is possible to perform a high quality recording in high precision by discharging small liquid droplets of color recording liquid.

Also, it may be possible to arrange the structure so that the liquid discharge method of the recording element on the recording element substrate having black liquid being supplied thereto as ink generates bubbling in ink by action of the recording element, and extinguishes bubbling by defoaming the bubble formed by such bubbling, and the liquid discharge method of the recording element on the recording element substrate having color liquid being supplied thereto as ink enables the bubble formed by bubbling to be communicated with the outside through the discharge port when ink is bubbled by action of the recording element. With the structure thus arranged, the bubbling pressure escapes outside after color recording liquid is discharged to make the vibrations of meniscus smaller at the time of debubbling. Then, refilling can be performed quickly, which contributes to the execution of a higher speed recording.

A plurality of recording element substrates are provided with the substrates of substantially the same thickness arranged on one and the same plane, and discharge port formation members laminated on the substrates, and then, the distance between the recording element and the discharge port of at least one of the recording element substrate may be made different owing to the different height of the discharge port formation member thereof form that of the other recording element substrate.

In accordance with the present invention, it is possible to provide one ink jet recording head with a plurality of recording element substrates each having different distance between the recording element and discharge port, respectively. As a result, each individual recording element substrate having different discharge method or different amount of discharges, respectively, can be arranged one integrally formed ultra-small recording head without preparing a plurality of ink jet recording heads. Therefore, black ink forms large liquid droplets, while color ink forms small liquid droplets. Thus, recording in black ink is performed efficiently at a higher speed, while recording in color ink can be made in a higher quality. Then, a plurality of recording element substrates can be capped easily with one integrally formed cap member reliably. Further, with a simple structure, the recording element substrates themselves can be arranged as closely as possible to make the recording head itself smaller as a matter of course, and also, make the main scanning width of the recording head itself narrower significantly. Consequently, there is no fear at all that the apparatus becomes larger, while making it possible to suppress the costs of manufacture.

DETAILED DESCRIPTION OF THE PREFERRED EMBODIMENTS

Hereinafter, with reference to the accompanying drawings, the detailed description will be made of the embodiments in accordance with the present invention.

FIG. 1 to FIG. 4 are views which illustrate the structures of a recording head cartridge, a recording head, and an ink tank, respectively, which are adopted preferably for one embodiment of the ink jet recording apparatus of the present invention, as well as the respective relations between them.

Figure 1:
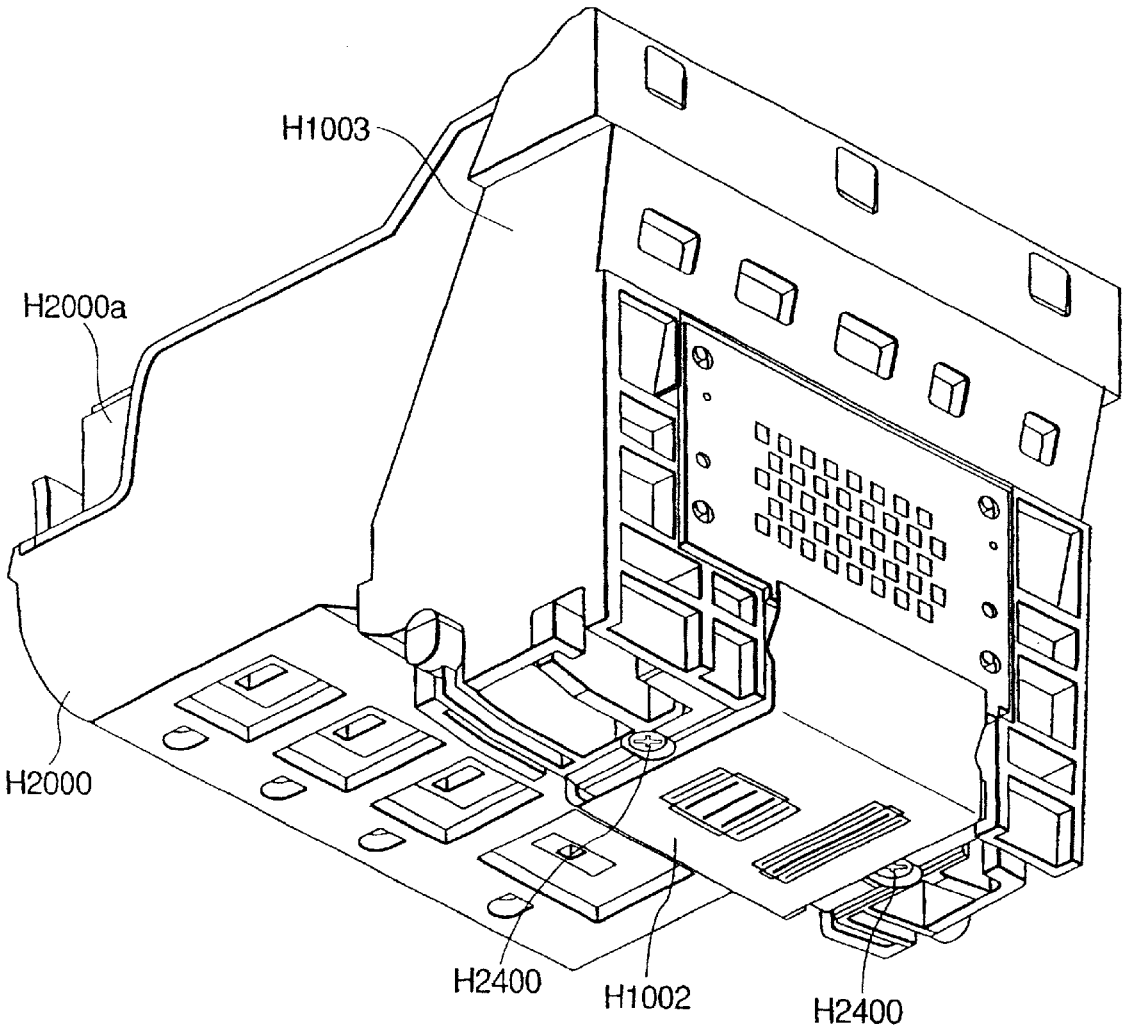
FIG. 1 is a perspective view which shows a recording head cartridge in accordance with a first embodiment of the present invention.
Figure 2:
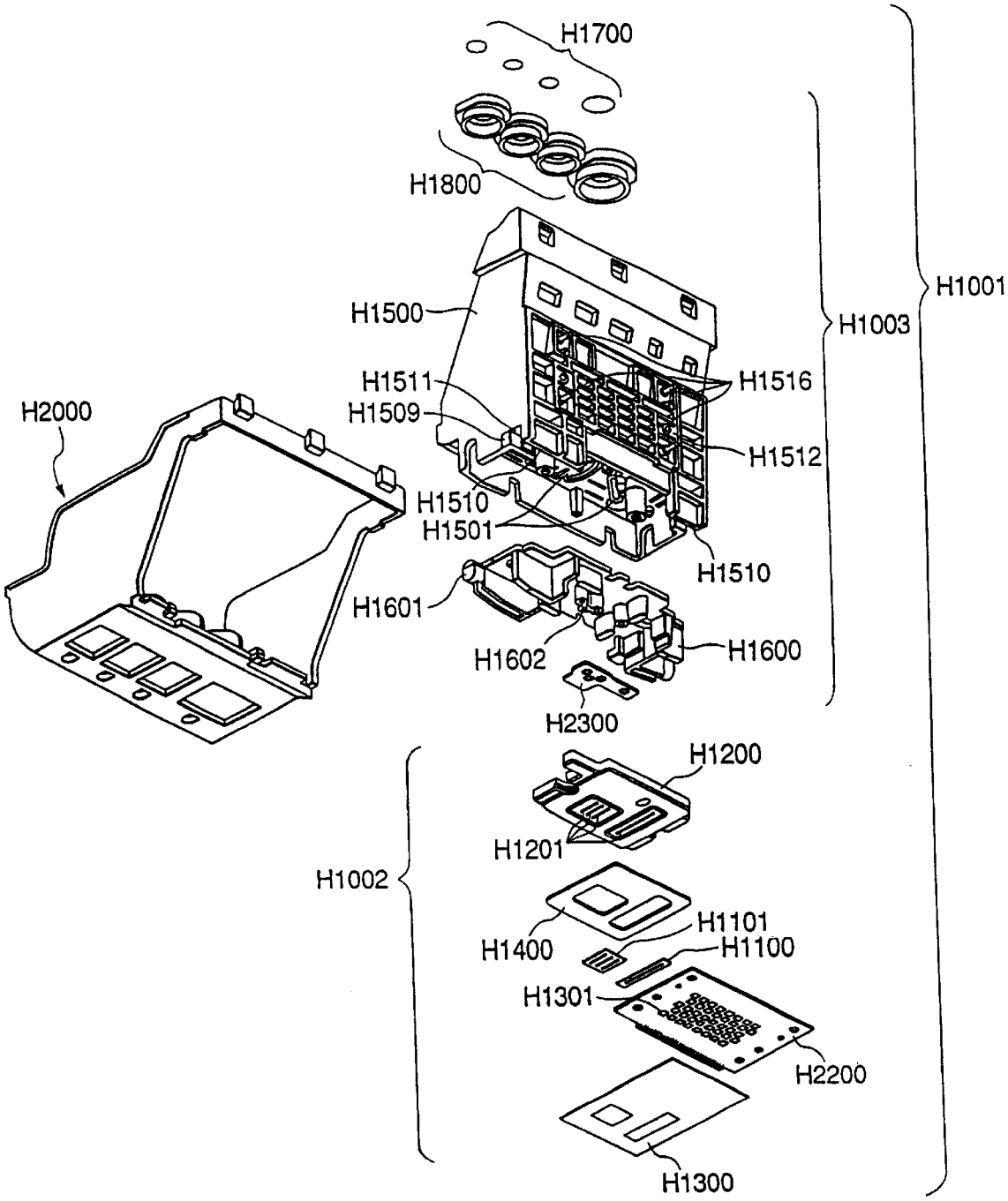
FIG. 2 is an exploded perspective view which shows the structure of the recording head represented in FIG. 1.

The recording head of the present embodiment (ink jet recording head) is one constituent that forms the recording head cartridge as understandable from the representation of FIG. 1 and FIG. 2. Then, the recording head cartridge comprises a recording head and ink tanks which are installed on the recording head to be freely attachable or detachable. The recording head discharges from discharge ports the ink (recording liquid) which is supplied from each of the ink tanks in accordance with recording information.

The recording head cartridge is supported to be fixed on the main body of an ink jet recording apparatus by use of positioning means and electrical contacts of a carriage (not shown), while being arranged to be detachably mountable on the carriage. Then, four ink tanks H2000*a* are provided each for black ink use, cyan ink use, magenta ink use, and yellow ink use, respectively. Then, each of these ink tanks is made freely detachable from or attachable to the recording head on the sealing rubber H1800 side, and each of the tanks is made replaceable, hence making it possible to reduce the running costs of printing by use of the ink jet recording apparatus.

Next, further description will be made of the recording head in detail per constituent one after another, which forms the recording head.

(1) Recording Head

The recording head H1001 is the one which is the side shooter type using the bubble jet method that records using electrothermal converting devices (recording elements) to generate thermal energy for creating film boiling in ink in accordance with electric signals.

As shown in FIG. 2 which is an exploded perspective view, the recording head H1001 comprises a recording element unit H1002; an ink supply unit (recording liquid supply means) H1003; and a tank holder H2000.

Further, the recording element unit H1002 comprises a first recording element substrate H1100; a second recording element substrate H1101; a first plate (first supporting member) H1200; an electric wiring tape (flexible wiring substrate) H1300; an electric contact board H2200; and a second plate (second supporting member) H1400. Also, the ink supply unit H1003 comprises an ink supply member H1500; a flow path formation member H1600; a joint sealing member H2300; a filter H1700; and a sealing rubber H1800.

(1-1) Recording Element Unit

Figure 3:
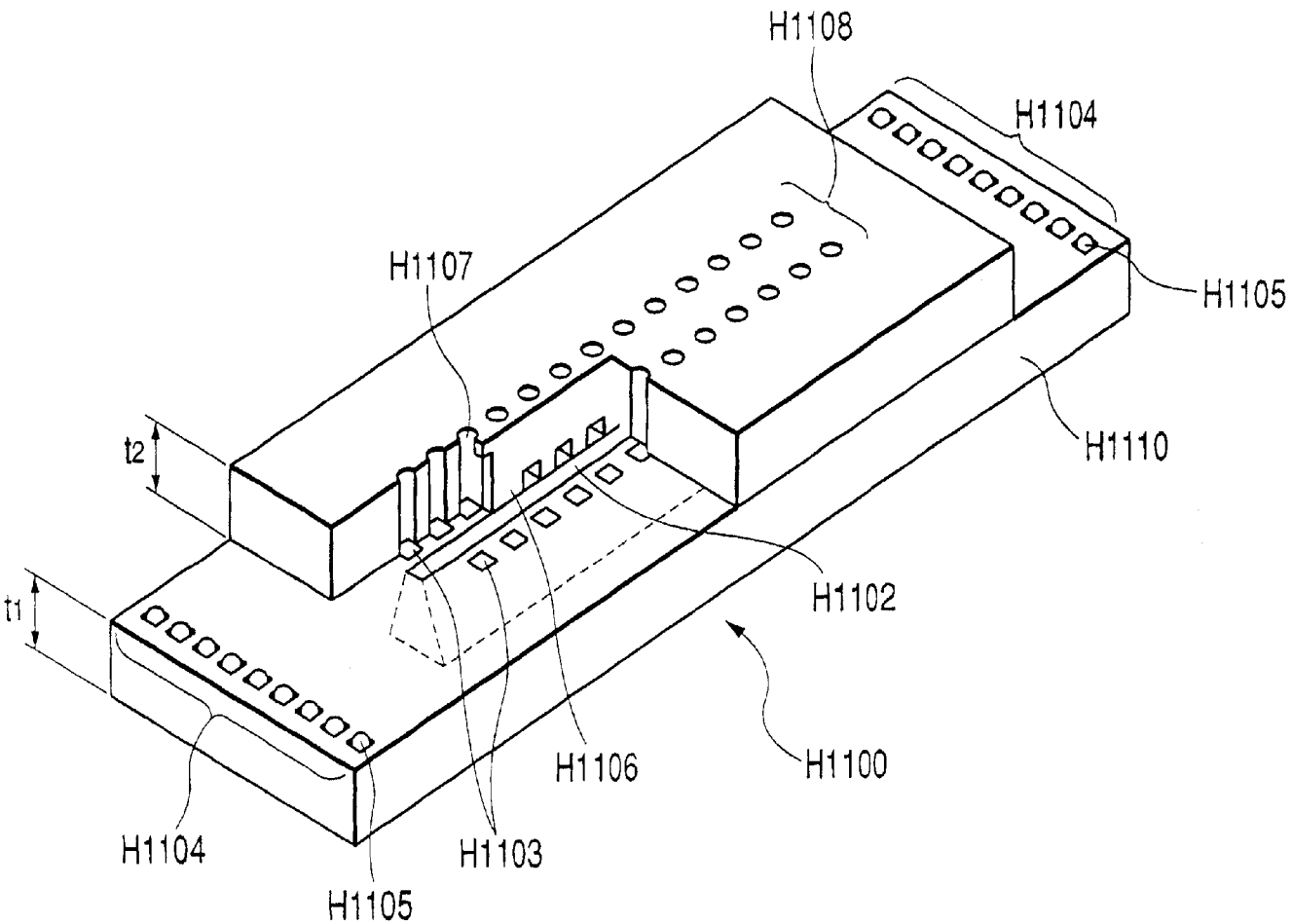
FIG. 3 is a partially broken perspective view which illustrates the structure of the recording element substrate in accordance with the first embodiment of the present invention.

FIG. 3 is a partly exploded perspective view which shows the structure of the first recording element substrate H1100. For the first recording element substrate H1100, there are formed by means of film formation technology and technique a plurality of recording elements (electrothermal converting devices) H1103 and electric wiring, such as aluminum (Al), for supplying electric power to each of the electrothermal converting devices H1103 on one side of silicon (Si) substrate H1110 in a thickness of 0.51 mm. Then, a plurality of ink flow paths and a plurality of discharge ports H1107 corresponding to the electrothermal converting devices H1103 are formed by means of photolithographic technology and technique, while the ink supply port H1102 for supplying ink to a plurality of ink flow paths is formed to be open to the face on the opposite side (reverse side). Also, the recording element substrate H1100 is adhesively bonded and fixed to the first plate H1200, and the ink supply port H1102 is formed here. Further, to the first plate H1200, the second plate H1400, which is provided with an opening portion, is adhesively bonded and fixed. Through this second plate H1400, the electric wiring tape H1300 is held to be electrically connected with the recording element substrate H1100. The electric wiring tape H1300 is to apply electric signals to the recording element substrate H1100 for discharging ink, and provided with the electric wiring corresponding to the recording element substrate H1100, and the external signal input terminals H1301 which is positioned in the electric wiring portion to receive electric signals from the printer main body. The external signal input terminals H1301 are positioned and fixed to the reverse side of the ink supply member H1500.

The ink supply port H12102 is formed by means of anisotropic etching that utilizes the Si crystalline orientation, sand blasting, or the like. In other words, if the Si substrate H1110 has the crystal orientation of <100> in the wafer direction, and the crystal orientation of <111> in the thickness direction thereof, the anisotropic etching can be carried out at an angle of approximately 54.7 degrees by use of alkali (KOH, TMAH, hydrazine, or the like). In this way, the etching is made in a desired depth to form the ink supply port H1102 having the through opening in the form of elongated groove. Each one line of the electrothermal converting devices H1103 is arranged in the zigzag form, respectively, on either side across the ink supply port H1102. There are formed the electrothermal converting devices H1103 and the electric wiring, such as Al, that supplies electric power to the electrothermal converting devices H1103 by means of film formation technology and technique. Further, the electrodes H1104 that supply electric power to the electric wiring are arranged on the outer sides of the electrothermal converting devices H1103, respectively, and bumps H1105, such as gold (Au), are formed for the electrodes H1104 by the thermo-ultrasonic pressurized welding method. Then, on the Si substrate H1110, the ink flow path walls H1106 and the discharge ports H1107 are formed with resin material by the photolithographic technology and technique for the formation of ink flow paths corresponding to the electrothermal converting devices H1103, thus forming the discharge port group H1108. Since the discharge ports H1107 are arranged to face the electrothermal converting devices H1103, ink supplied from the ink supply port H1102 is discharged from the discharge ports H1107 by means of bubbles generated by the heating action of the electrothermal converting devices H1103.

Figure 4:
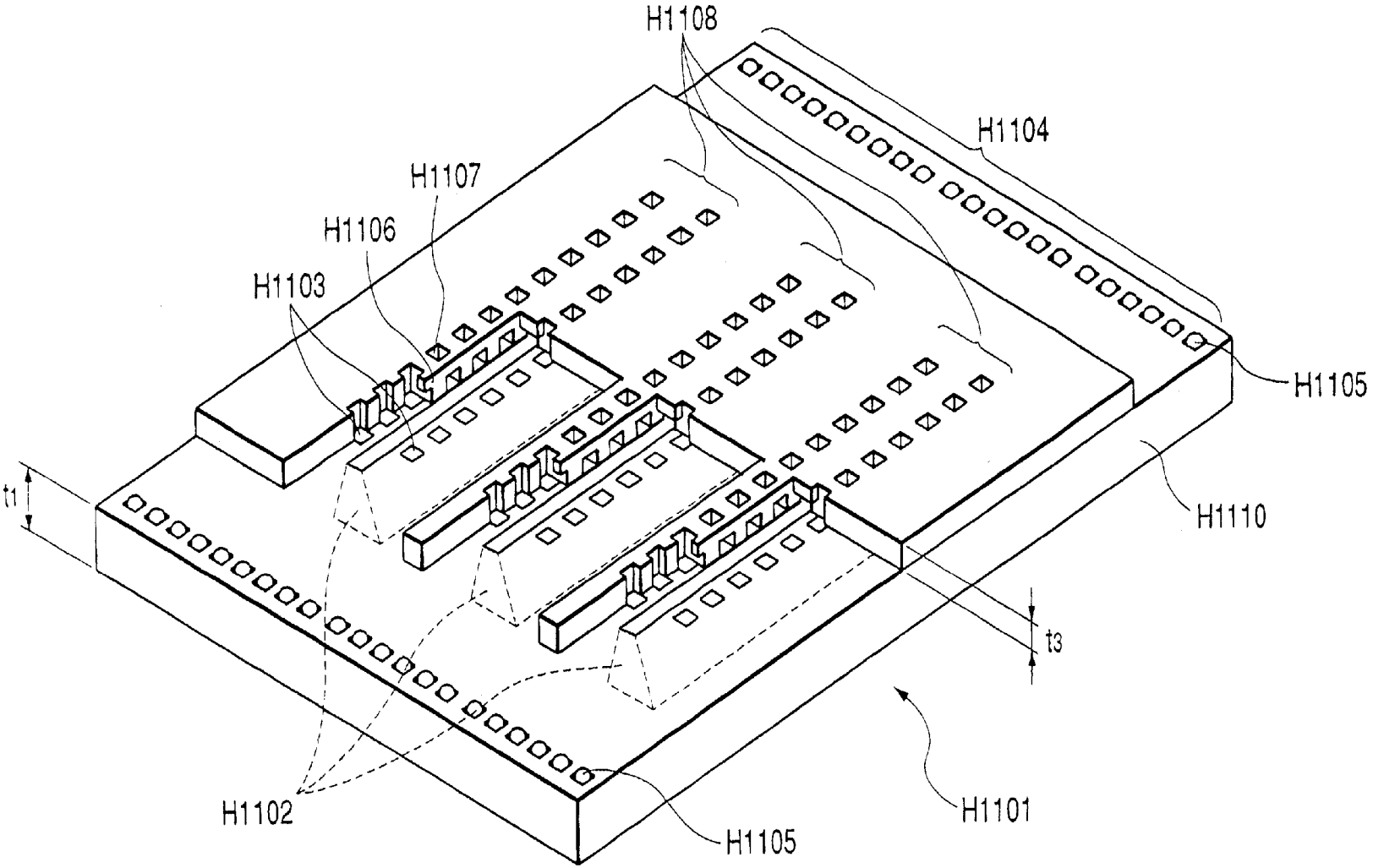
FIG. 4 is a partially broken perspective view which illustrates the structure of another recording element substrate in accordance with the first embodiment of the present invention.

Also, FIG. 4 is a partly broken perspective view which illustrates the structure of the second recording element substrate H1101. The second recording element substrate H1101 is the one for discharging ink of three colors. Here, three ink supply ports H1102 are formed in parallel, and electrothermal converting devices H1103 and ink discharge ports H1107 are formed on both sides having each of the ink supply ports H1102 between them. In the same manner as forming the first recording element substrate H1110, the ink supply ports H1102, electrothermal converting devices H1103, electric wiring, electrodes H1104, and others are formed on the Si substrate H1110, and the ink flow paths and ink discharge ports H1107 are formed on them with resin material by means of the photolithographic technology and technique. Then, as in the case of the first recording element substrate H1100, the bumps H1105 of Au or the like are formed for the electrodes H1104 to supply electric power to the electric wiring. Then, the first plat H1200 is formed by Alumina ($Al_2O_3$) material of 0.510 mm thick, for example. Here, the material of the first plate H1200 is not necessarily limited to alumina, but this plate may be produced with the material which has the same linear expansion coefficient as that of the material of the recording element substrate H1100, having also the same heat conductivity as or more than that of the material of the recording element substrate H1100. The material of the first plate H1200 may be either one of silicon (Si), aluminum nitride (AlN), zirconium, silicon nitride ($Si_3N_4$), silicon carbide (SiC), molybdenum (Mo), and tungsten (W), for example. For the first plate H1200, there are formed the ink supply port H1201 for supplying black ink to the first recording element substrate H1100, and the ink supply ports H1201 for supplying cyan, magenta, and yellow ink to the second recording element substrate H1101. The ink supply ports H1102 of the recording element substrate are arranged to correspond to the ink supply ports H1201 of the first plate H1200, respectively, and then, the first recording element substrate H1100 and the second recording element substrate H1101 are positioned and bonded to the first plate H1200 to be fixed in good precision. Here, it is desirable to use the first bonding agent which has low viscosity with low hardening temperature so that it can be hardened in a short period of time, while having a relatively high hardness after hardened, as well as a good resistance to ink. Such first bonding agent is, for example, a thermal hardening bonding agent having epoxy resin as its main component, and the thickness of this first bonding layer should preferably be 50 $\mu$m or less.

The electric wiring tape H1300 is for the application of electric signals to the first recording element substrate H1100 and the second recording element substrate H1101 for discharging ink, and the electric wiring tape H1300 comprises a plurality of device holes (opening portions) H1 and H2 for incorporating each of the recording element substrates H1100 and H1101; the electrode terminals H1302 that correspond to the electrodes H1104 on the respective recording element substrates H1100 and H1101; and the electrode terminals unit to make electrical connection with the electric contact substrate H2200 provided with the external signal input terminals H1301 which is positioned on the edge portion of the wiring tape H1300 for receiving electric signals from the apparatus main body. The electrode terminal unit and the electrode leads H1302 are connected by use of a continuous wiring pattern of copper foil. The electric wiring tape H1300 is formed by the flexible wiring substrate with wires of two-layered structure, and the surface layer thereof is covered by resist film. In this case, on the reverse side (outer face side) of the external signal input terminal H1301, a reinforcement plate is bonded to attempt the enhancement of the flatness thereof. As the reinforcement plate, a heat resistive material, such as glass epoxy, aluminum, or the like in a thickness of 0.520 mm, for example.

The electric wiring tape H1300, the first recording element substrate H1100, and the second recording element substrate H1101 are connected electrically, respectively. The connecting method is, for example, such that the bumps H1105 on the electrodes H1104 of the recording element base pate and the electrode leads H1302 of the electric wiring tape H1300 are electrically coupled by means of thermo-ultrasonic pressurized welding.

The second plate H1400 is, for example, one-sheet plate member of 0.5 to 1.0 mm thick, and formed by ceramics, such as alumina ($Al_2O_3$) or metallic material, such as Al, SUS. However, the material of the second plate H1400 is not necessarily limited thereto. The material may be the one that has the same linear expansion coefficient as that of the recording element substrates H1100 and H1101, and the first plate H1200, and also, has the same heat conductivity as or more than that of these element and plates.

Then, the second plate H1400 is configured to be provided with the opening portion larger than the contour dimension of the first recording element substrate H1100 and the second recording element substrate H1101 which are bonded and fixed to the first plate H1200, respectively. Also, in order to connect the first recording element substrate H1100, the second recording element substrate H1101, and the electric wiring tape H1300 electrically on the plane, the second plate is bonded to the first plate H1200 by means of the second bonding layer H1203, thus bonding and fixing the reverse side of the electric wiring tape H1300 with the third bonding layer H1306.

The electrically connected portions of the first recording element substrate H1100, the second recording element substrate H1101, and the electric wiring tape H1300 are sealed by a first sealant (not shown) and second sealant in order to protect the electrically connected portions from erosion due to ink, and from external shocks as well. The first sealant seals mainly the reverse side of the connected portion between the electrode terminal H1302 of the electric wiring tape and the bumps H1105 of the recording element substrate, and the outer circumferential portion of the recording element substrate. The second sealant seals the surface side of the connected portion described above.

Further, the electric contact base board H2200, which is provided with the external signal input terminal H1301 to receive electric signals from the printer main body, is electrically connected with the edge portion of the electric wiring tape H1300 by means of thermally pressurized bonding using anisotropic conductive film or the like.

Then, at the same time that the electric wiring tape H1300 is bonded to the second plate H1400, the electric wiring tape is folded on one side face of the first plate H1200 and the second plate H1400 to be bonded to the side face of the first plate H1200 by use of the third bonding agent H1306. The second bonding agent should preferably be the one having low viscosity, being capable of forming thin second bonding layer H1203 on the contact face, while having resistance to ink. Also, the third bonding layer H1306 is, for example, a thermo-hardening bonding layer of 100 $\mu$m thick or less with epoxy resin as its main component.

(1-2) Ink Supply Unit (Recording Liquid Supply Means)

The ink supply member H1500 is formed by means of resin molding, for example. For the resin material thereof, it is desirable to use the resin material in which glass filler is mixed in 5 to 40% to enhance the robustness of the form.

As shown in FIG. 1 and FIG. 2, the ink supply member H1500, which holds the ink tanks to be freely attachable or detachable, is one of the constituents to form the ink supply unit H1003 that conducts ink from the ink tanks to the recording element unit H1002, and the ink flow paths H1501 are formed between the ink tanks and the first plate H1200 when the flow path formation member H1600 is welded thereto by means of ultrasonic welding Also, to the joint portion coupled with the ink tanks, the filter H1700 is bonded by means of welding in order to prevent external dust particles from entering them. Further, in order to prevent ink evaporation from the joint portion, a sealing rubber H1800 is provided therefor.

Also, there are provided an installation guide H1601 to guide the recording head cartridge to the installing position of the carriage on the main body of an ink jet recording apparatus; the coupling portion where the recording head cartridge is installed and fixed to the carriage by use of a head set lever; an abutting portion H1509 for positioning the carriage in a designated position of installation in the direction X (carriage scanning direction); an abutting portion H1510 in the direction Y (recording medium carrying direction); and an abutting portion H1511 in the direction Z (ink discharging direction). Also, it is arranged to provide the terminal fixing portion H1512 that positions and fixes the electric contact substrate H2200 of the recording element unit H1002. Then, with a plurality of ribs arranged for the terminal fixing portion H1512 and the circumference thereof, the robustness is enhanced for the surface where the terminal fixing portion H1512 is provided.

(1-3) Coupling of the Recording Head Unit and the Ink Supply Unit

As described earlier in conjunction with FIG. 2, the recording head is completed by bonding the recording unit H1002 with the ink supply unit H1003, and further with the tank holder H2000. The bonding is executed as follows:

The ink communication port (ink communication port H1201 of the first plate H1200) of the recording element unit H1002 and the ink communication port (ink communication port H1602 of the liquid flow path formation member H1600) of the ink supply unit H1003 should be communicated without causing any ink leakage. To this end, each of them is fixed by use of screws H2400 to be fixed under pressure with the joint sealing member H2300 between them. Here, at the same time, the recording element unit H1002 is positioned and fixed exactly to the standard positions of the ink supply unit in the direction X, direction Y, and direction Z.

Then, the electric contact substrate H2200 of the recording element unit H1002 is positioned and fixed to one side face of the ink supply member H1500 by use of the terminal positioning pins (two locations) and the terminal positioning holes (two locations). The fixing method is, for example, such as to caulk and fix the terminal coupling pins provided for the ink supply member H1500, but any other fixing means may be usable.

Further, the coupling hole and the portion of the ink supply member H1500 to be coupled with the tank holder are fitted into and coupled with the tank holder H2000 to complete the recording head H1001. In other words, the tank holder unit structured by the ink supply member H1500, the flow path formation member H1600, the filter H1700, and the sealing rubber H1800 are bonded with the recording element unit structured by the recording element substrates H1100 and H1101, the first plate H1200, the wiring substrate H1300, and the second plate H1400 by means of bonding or the like, thus forming the recording head.

(2) Description of Recording Head Cartridge

As described earlier, in each interior of the ink tanks, ink of a corresponding color is contained. Also, for each of the ink tanks, an ink communication port is formed for supplying ink in the ink tank to the recording head. For example, an ink tank is installed on the recording head, the ink communication port of the ink tank is pressed to be in contact with the filer H1700 which is provided for the joint portion of the recording head, and ink in the ink tank is supplied to the first recording element substrate H1100 from the ink communication port by way of the first plate H1200 through the ink flow path H1501 of the recording head.

Then, ink is supplied to the bubbling chamber having the electrothermal converting device H1103 and the discharge port H1107 arranged therefor, and ink is discharged to a recording sheet serving as a recording medium by the application of thermal energy given by the electrothermal converting device H1103.

First Embodiment

With reference to FIG. 5 to FIG. 12, a first embodiment will be described in accordance with the present invention.

Figure 5:
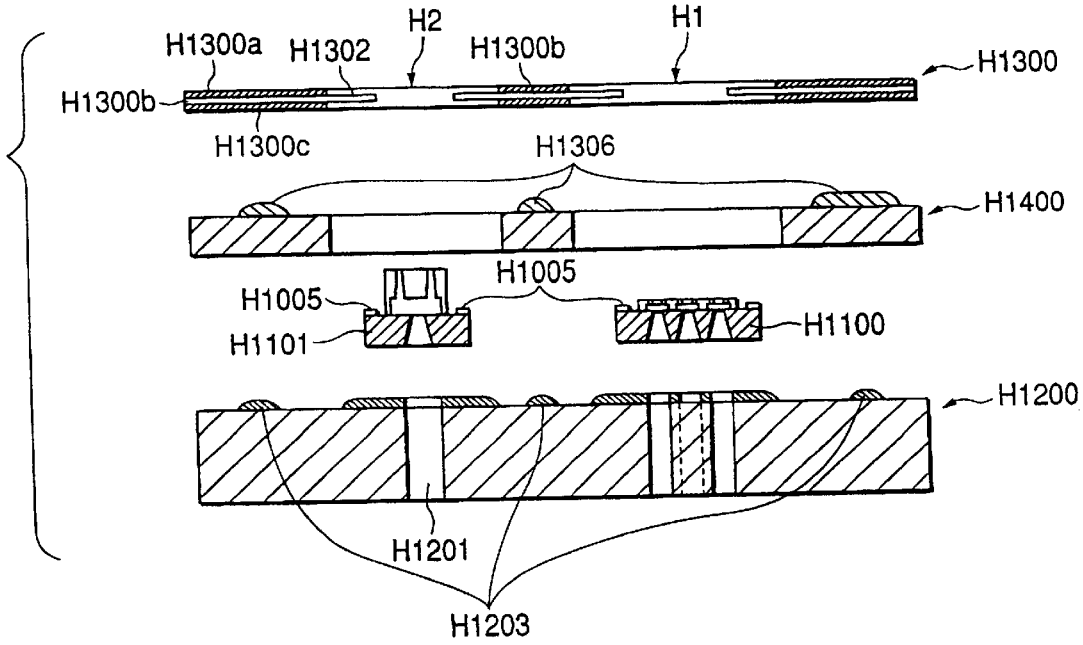
FIG. 5 exploded views which schematically illustrate the principal part of the recording element unit in accordance with the first embodiment of the present invention.
Figure 6:
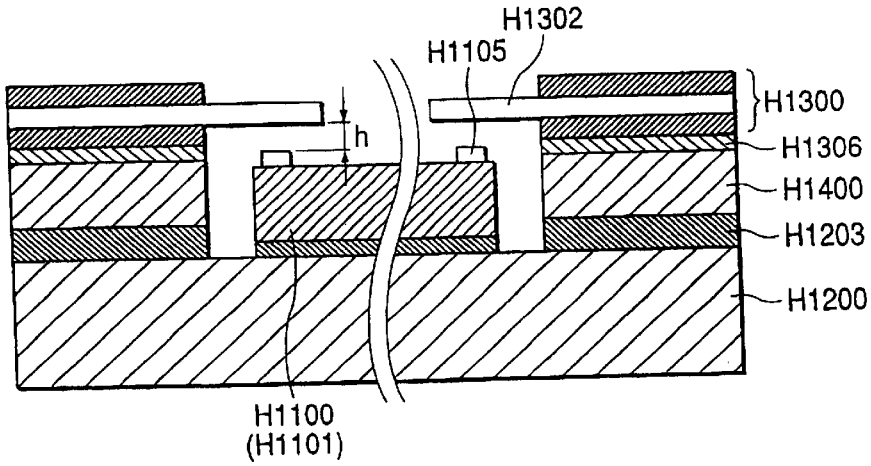
FIG. 6 is an enlarge cross-sectional view which shows the principal part of the recording element unit in accordance with the first embodiment of the present invention.
Figure 7:
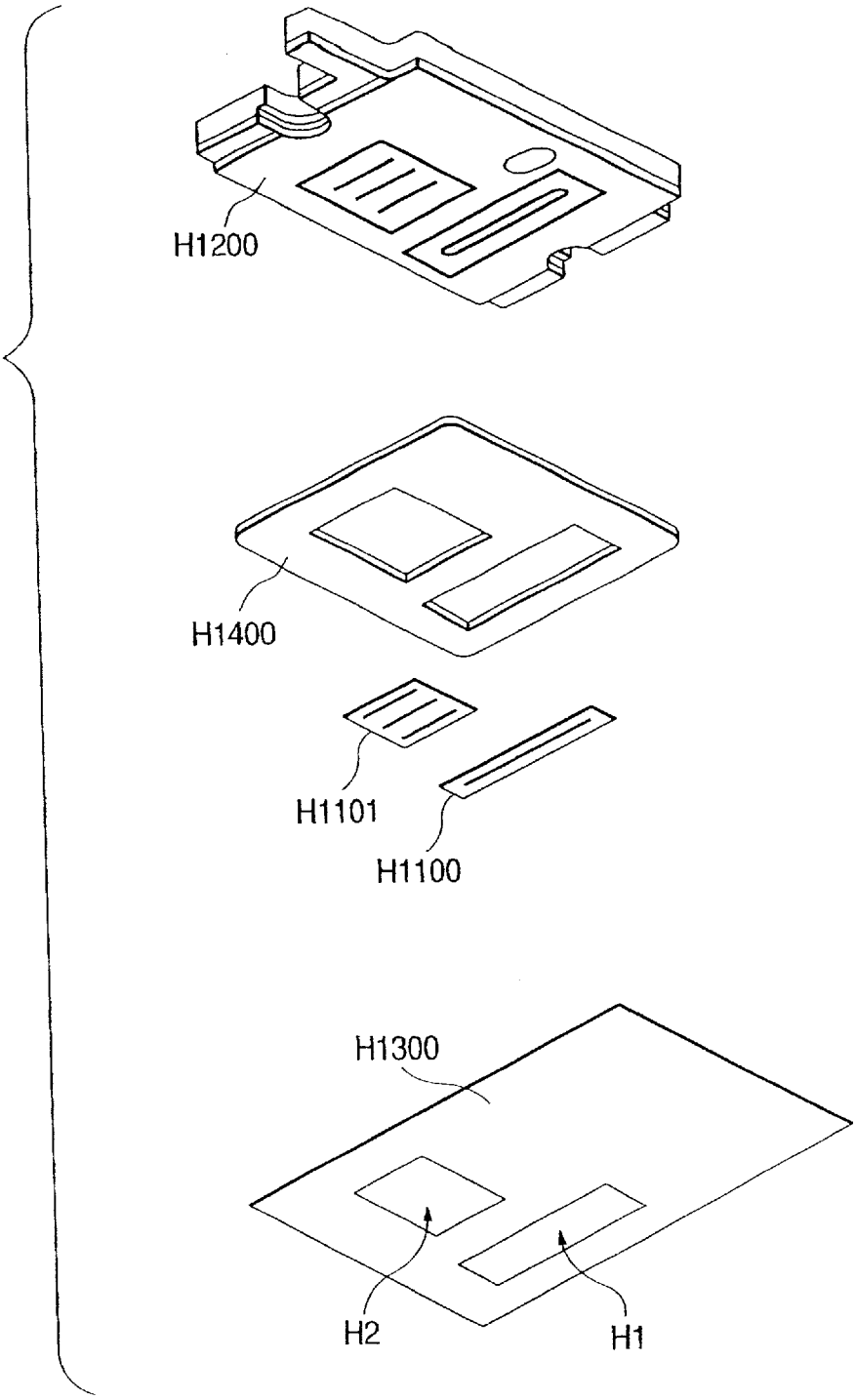
FIG. 7 is the enlargement of an exploded perspective view which shows the principal part of the recording element unit in accordance with the first embodiment of the present invention.
Figure 8A:
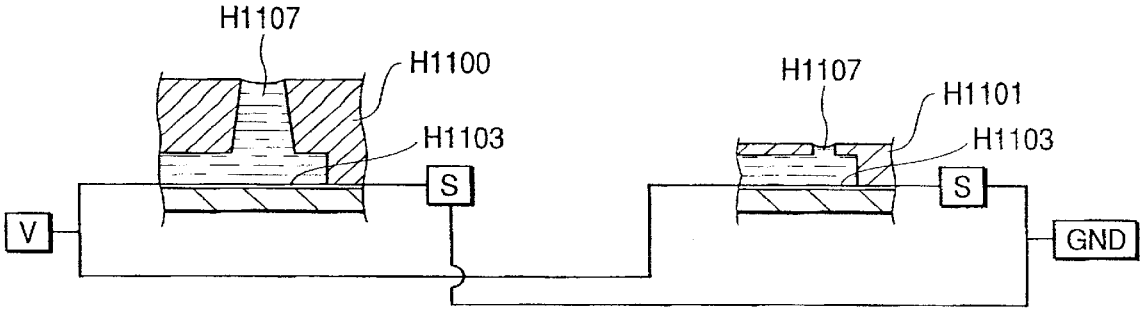
FIGS. 8A, 8B, 8C, and 8D are views which schematically illustrate two ways of the ink discharge methods.
Figure 8B:
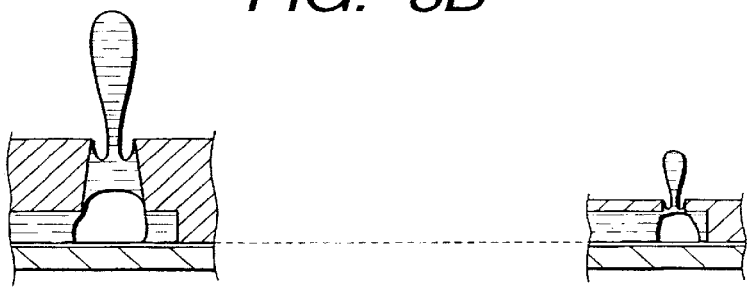
Figure 8C:
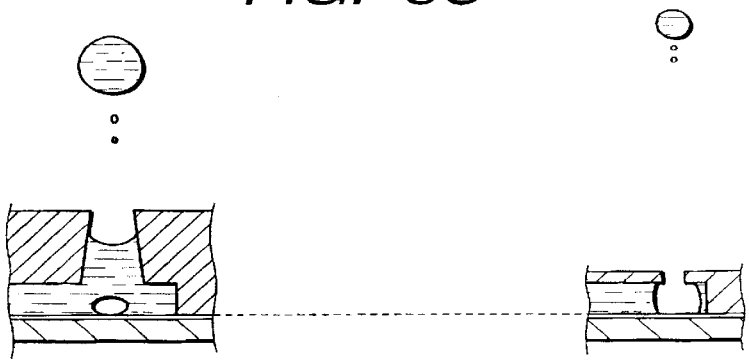
Figure 8D:
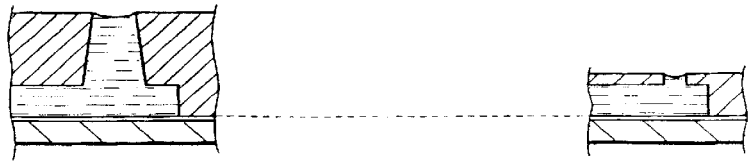

FIG. 5 is an exploded cross-sectional view which schematically shows the principal part of the recording element base unit H1002. FIG. 6 is a cross-sectional view which schematically shows the principal part thereof.

As shown in FIG. 5, the circumference of the bonding portion of the electric wiring tape H1300 is three-layer structured with a base film H1300*a* of polyimide on the surface side, copper foil H1300*b* in the middle, and a solder resist H1300*c* on the rear side. For this electric wiring tape H1300, there are provided the device holes (opening portion) H1 for the first recording element substrate H1100 to be inserted, and the device holes H2 for the second recording element substrate H1101 to be inserted, and then, the inner leads (electrode leads) H1302, which are gold plated and connected with the bumps H1005 of the recording element substrates H1100 and H1101, are exposed.

Now, hereunder, with reference to FIG. 9 and FIG. 10, the description will be made of a method for manufacturing a recording element unit in the order of the steps thereof in accordance with the present embodiment.

At first, the method will be described for manufacturing the first and second recording element substrates.

FIG. 10 to FIG. 16 are views which illustrate schematically the fundamental mode of the first and second recording element substrates (ink jet recording head), in which one example is shown as to the structure of an ink jet recording head, and the manufacturing steps thereof.

Figure 10:
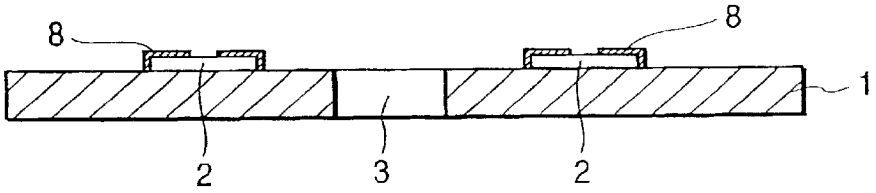
FIG. 10 is a view which schematically shows the substrate before the formation of ink flow path and orifice member.

At first, in accordance with the present embodiment, the substrate 1, which is formed by glass, ceramics, plastics, metal, or the like, is used as shown in FIG. 10.

For the substrate 1 of the kind, any material may be usable without any particular limit to the configuration, material thereof, or the like if only such material can function as a part of the liquid flow path structural member, and also, as a supporting member for the material layer that forms the ink flow paths and ink discharge ports which will be described later. For the substrate 1 described above, there are arranged a desired number of ink discharge energy generating elements 2, such as electrothermal converting devices or piezoelectric elements. In order to enable the ink discharge energy generating elements 2 to discharge small droplets of recording liquid, discharge energy is given to ink liquid for recording. Here, for example, if the electrothermal converting device 2 is used as the aforesaid ink discharge energy generating element, recording liquid residing in the vicinity of the element is heated to generate the discharge energy that creates the changes of state in the recording liquid. Also, if the piezoelectric element is used, for example, the discharge energy is generated by means of the mechanical vibrations of this element.

Here, to these elements 2, control signal input electrodes 8 are connected to operate them. Also, in general, for the purpose to enhance the durability of these discharge energy generating elements, various functional layers, such as a protection layer, are provided for them. For the present invention, too, such functional layers can be provided without any problem as a matter of course.

In FIG. 10, an example is shown, in which an opening portion 3 is provided in advance on the substrate 1 for supplying ink, and ink is supplied from the rear side of the substrate 1. For the formation of the opening portion 3, any means is usable if only it can form holes. For example, there is no problem if holes are formed by use of mechanical means such as drilling or by use of light energy such as laser.

Also, there is no problem to use chemical etching after the formation of resist pattern on the substrate 1.

It is of course possible to form the ink supply ports on a resin pattern to provide them on the same face of the substrate 1 as the ink discharge ports without forming them on the substrate 1.

Figure 11:
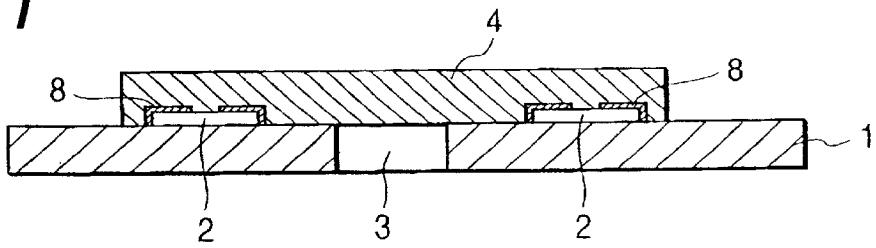
FIG. 11 is a view which schematically shows the substrate having a soluble ink flow path pattern formed therefor.

Next, as shown in FIG. 11, on the substrate 1 that includes the ink discharge energy generating elements 2, the ink flow path pattern 4 is formed with soluble resin. As means used most widely in general, there is the one that forms such pattern with photosensitive material, but it is possible to form the pattern by is means of screen press method or the like. When photosensitive material is used, it is possible to adopt a positive type resist or the negative resist that may change by solubility, because the ink flow path pattern is soluble.

As the method for forming the resist layer, the photosensitive material is dissolved by use of an appropriate solvent when the substrate, which is provided with the ink supply port thereon, is used, and coated on a film, such as PET, and dried to produce a dry film. Here, it is preferable to form the resist layer by means of laminating. For the dry film described above, it is possible to preferably use a polymeric compound of luminous decay type, such as polymethylisopropylketone, polyvinylketone. This is because these compounds maintain characteristics (covering capability) as polymeric compound before giving light irradiation, making it easier to laminate on the ink supply port 3.

Also, it may be possible to form film without any problem by means of usual spin coating method, roller coating method, or the like by arranging a removable filler for the ink supply port 3 in the post process thereof.

Figure 12:
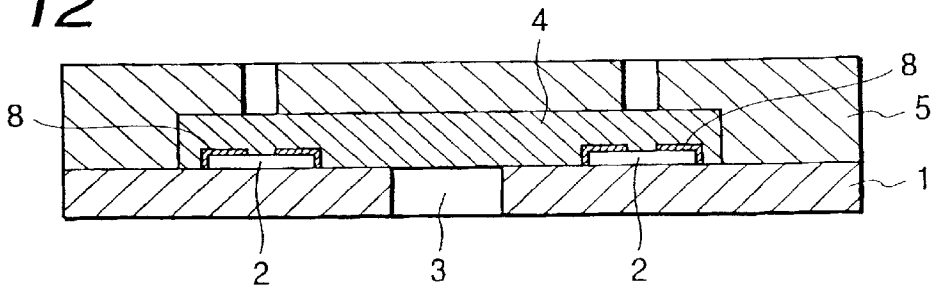
FIG. 12 is a view which schematically shows the substrate having a covering resin layer formed therefor.

As described above, on the soluble resin material layer 4 having the ink flow path patterned therefor, the covering resin layer 5 is further formed by the usual spin coating method, roller coating method, or the like as shown in FIG. 12. Here, in the process of forming the resin layer 5, there is a need for keeping a special property so as not to allow the soluble resin pattern to be deformed, among some others. In other words, the covering resin layer 5 is dissolved by a solvent, and when it is formed on the resin pattern 4 by means of spin coating, roller coating, or the like, the solvent must be selected so as not to dissolve the soluble resin pattern 4.

Next, the description will be made of the covering layer 5 used for the present embodiment. As the covering resin layer 5, it is preferable to use a photosensitive one, because with such material, it is easier to from the ink discharge port 3 by means of photolithography in good precision. For such photosensitive covering layer 5, it is required to present a high mechanical strength as the structural material, a close contactness as the substrate 1, as well as resistance to ink, and at the same time, to provide good resolution for patterning the minute patterns of ink discharge ports. Therefore, as the structural material here, the cationic polymer hardening substance of epoxy resin is excellent in the strength, closeness, and resistance to ink, and also, the epoxy resin presents an excellent patterning capability if it is solidified at the room temperature.

Now, first of all, the cationic polymer hardening substance of epoxy resin presents a high bridging density (high Tg) as compared with the usual acid anhydride or a hardening substance by amine, and as the structural material, it demonstrates an excellent property. Also, with the use of the epoxy resin which is solidified at the room temperature, it is possible to suppress the diffusion of the polymer initiator seed, which has been generated by the cationic polymer initiator due to light irradiation, into the epoxy resin, hence obtaining an excellent patterning precision, as well as an excellent configuration.

For the process of forming the covering resin layer on the soluble resin layer, it is desirable to dissolve the covering resin layer, which has been solidified at the room temperature, by use of solvent, and form the layer by means of spin coating.

Here, by use of the spin coating method which is a thin film coating technique, it is possible to form the covering layer 5 uniformly in good precision, and shorten the distance between the ink discharge pressure generating element 2 and the discharge port unlike the conventional method with which the implementation thereof is difficult, thus attaining the discharge of small liquid droplets with ease.

Here, in order to form the covering resin layer 5 flat on the soluble resin layer 4, the density of the covering resin layer is set at 30 to 70 wt % against solvent or more preferably, 40 to 60 wt % for dissolution at the time of spin coating. In this manner, the surface of the covering layer 5 can be made flat.

As the solidified epoxy resin used for the present embodiment, there is the reactant of bisphenol A and epichlohydrine the molecular weight of which is more than 900, the reactant that contains bromosphenol A and epichlohydrine, the reactant of phenolnovolak or o-cresolnovolak and epichlohydrine, multisensitive epoxy resin having the oxycyclohexane skeletal structure which is disclosed in the specifications of Japanese Patent Laid-Open Applications 60-161973, 63-221121, 64-9216, and 02-140219, or the like.

As the light cationic polymer initiator for hardening the aforesaid epoxy resin, there is aromatic iodonium salt, aromatic sulfonium salt (see J.POLYMER SCI:Symposium No. 56 383–395 (1976)), the SP-150, SP-170 sold by Asahi Denka Kogyo K.K. or the like.

Figure 13:
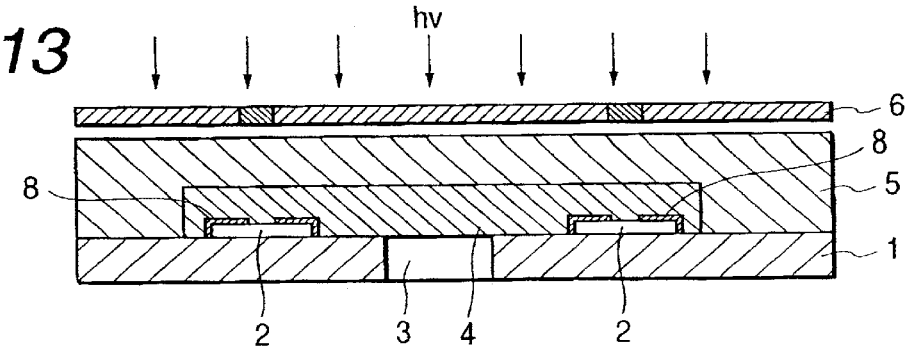
FIG. 13 is a view which schematically shows the substrate for which the patterning exposure of ink discharge ports is being given to the covering resin layer thereof.

Next, in continuation, a patterning exposure is given to the photosensitive covering resin layer 5 composed by the aforesaid compound through the mask 6 as shown in FIG. 13. The photosensitive covering resin layer 5 of the present embodiment is of negative type, and the portion where ink discharge port is formed is covered by a mask (the portion where electric connections are made is of course covered, too, although not shown).

For the pattern exposure, it is possible to select ultraviolet rays, Deep-UV rays, electron beams, X-rays, or the like arbitrarily depending on the photosensitive region of the light cationic polymer initiator to be used.

Here, in any of the steps so far, it is possible to perform positioning by use of the conventional lithographic technology and technique, and as compared with the method in which the orifice plate is produced separately and bonded to the substrate, the positioning precision can be significantly enhanced. Now, the photosensitive covering resin layer 5 thus pattern exposed may be given a heat treatment in order to promote reaction if necessary. Here, as described earlier, the photosensitive covering resin layer is formed by the epoxy resin which is solidified at the room temperature. Therefore, the diffusion of the cationic polymer initiator seed that may take plate due to the pattern exposure is controlled to implement the excellent patterning precision and configuration.

Figure 14:
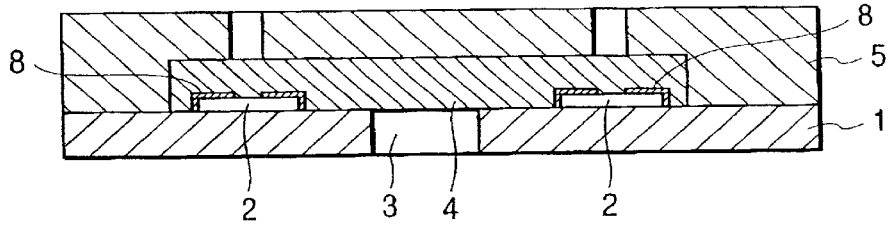
FIG. 14 is a view which schematically shows the substrate for which the patterned covering resin layer is being developed.
Figure 15:
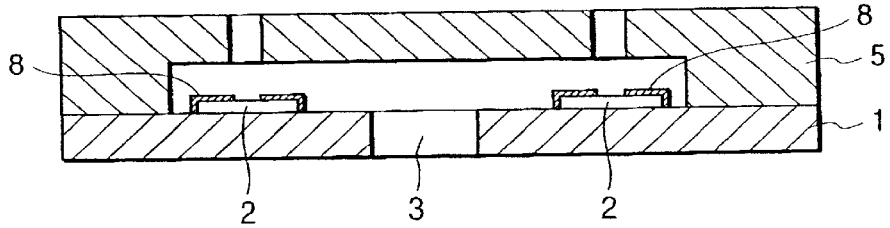
FIG. 15 is a view which schematically shows the substrate from which the soluble resin pattern is eluted.

Next, the photosensitive covering resin layer 5 thus pattern exposed is developed by use of an appropriate solvent, and as shown in FIG. 14, ink discharge ports are formed. Here, it may be possible to develop the soluble resin pattern 4 that forms the ink flow path at the same time when developing the photosensitive covering resin layer which is yet to be exposed. In general, however, a plurality of heads of the same or different modes are arranged on the substrate 1, and used as ink jet recording heads through a cutting process. Therefore, as shown in FIG. 14, only the photosensitive covering resin layer 5 is selectively developed, while keeping the resin pattern 4 that forms the ink flow path intact as a measure to prevent dust particles from being contained (that is, with the resin pattern 4 remaining in the liquid chamber, dust particles created at the time of cutting are not allowed to enter the chamber). The resin pattern 4 can be developed after cutting process (FIG. 15). Also, at this juncture, scum (development residue) created at the time of developing the photo-sensitive resin layer 5 is eluted together with the soluble resin layer 4. Such residue does not remain in the nozzle.

As described earlier, if there is a need for increasing the bridging density, the photosensitive covering resin layer 5 having ink flow paths and ink discharge ports formed therefor is immersed in a solvent containing reducing agent and heated for the post-hardening subsequent to the preceding process. In this way, the bridging density of the photosensitive covering resin layer 5 is further enhanced to make the contactness with the substrate and resistance to ink extremely excellent. Here, it is of course possible to carry out this process of immersing and heating in a solvent containing copper ion immediately after the patterning exposure and development of the photo-sensitive covering layer 5 for the formation of ink discharge ports without any problem. Then, the soluble resin pattern 4 can be eluted after that without any problem. Also, the immersing and heating process may be possible in such a manner as to heat while being immersed or to give heat treatment after immersion.

As a reducing agent of the kind, any substance that has reducing function is usable, but a chemical compound containing copper ion, such as copper trifullert, copper acetate, benzoate copper, is particularly effective. Of the aforesaid chemical compounds, the copper trifullert demonstrates extremely high effect in particular. Further, ascorbic acid is useful besides those mentioned here.

Figure 16:
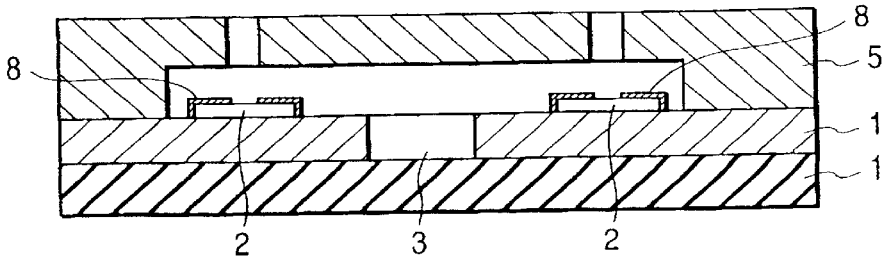
FIG. 16 is a view which schematically shows the substrate on which an ink supply member is arranged.

The substrate having the ink flow paths and ink discharge ports thus formed therefor is electrically connected for driving the member 7 that supplies ink and the ink discharge pressure generating elements (not shown) to complete an ink jet recording head (FIG. 16).

For the present embodiment, the formation of ink discharge ports is made by means of photolithography, but the present invention is not limited thereto. It may be possible to from the ink discharge ports by means of dry etching using oxygen plasma or excimer laser by changing masks accordingly. When the ink discharge ports are formed by means of excimer laser or dry etching, the substrate is protected by the resin pattern so that it is not damaged by the application of laser or plasma, thus making the provision of a highly precise and reliable head possible. Further, if the ink discharge ports are formed by means of dry etching or excimer laser, it becomes possible to adopt a covering resin layer 5 of thermohardening type besides the layer of photosensitive type.

Meanwhile, the second plate H1400 is bonded to the first plate H1200 by use of the second bonding layer H1203. Then, there is formed by coating the first bonding layer H1202 for use of bonding the first recording element substrate H1100 and the second recording element substrate H1101 to the first plate H1200, and then, the recording element substrates H1100 and H1101 are pressed for fixation after adjusting the relative positional relations with a plurality of electrothermal converting devices H1103 that discharge recording liquid or each of the discharge ports H1107 in the direction of wiring surface.

After that, the third bonding layer H1306 for bonding and fixing the reverse side of the electric wiring tape H1300 is coated and formed on the second plate H1400. Then, the first recording element substrate H1100, the electrodes H1104 of the second recording element substrate H1110, and the electrode leads H1302 of the electric wiring tape H1300 are positioned and pressed for fixation. Subsequently, the bumps H1105 on the electrodes H1104 of the recording element substrate and the electrode leads H1302 of the electric wiring tape H1300 are electrically bonded one place after another by use of thermo-ultrasonic pressurized welding method.

Further, joints between the bumps H1105 on the electrodes H1104 of the recording element substrate H1100 and the electrode leads H1302 of the electric wiring tape H1300 are sealed with resin to protect them from being short circuited by ink or the like.

For the present embodiment, the first plate H1200 and the second plate H1400 are formed by alumina. The electric wiring tape (flexible printed substrate) H1300 is structured with three layers by the base film, copper foil wiring, and soldering resists, and provided with device holes H1 and H2. The gold-plated electrode leads H1302 are exposed.

The second plate H1400 of the present embodiment is a single plate member having two holes for the recording element substrates H1100 and H1101 to be inserted, and fixed by being bonded to the first plate H1200. Also, the entire surface of the electric wiring tape H1300 is bonded to the second plate H1400 by use of the third bonding layer H1306 with the exception of the device holes H1 and H2 formed to enable the recording element substrates H1100 and H1101 to be exposed.

For the ink jet recording apparatus of the present embodiment, both the black head and the color head are incorporated on one and the same substrate for integration. Therefore, there is no need for correcting the impact positions of ink for the heads with each other.

In accordance with the present embodiment, black ink is discharge by use of the first recording element substrate H1100 of the ink jet recording head thus structured, and ink of three colors, cyan, magenta, and yellow, by use of the second recording element substrate H1101.

Also, the nozzle structure of the first recording element substrate H1100 is such that nozzles are arranged in zigzag across the ink supply path for 300 dpi on one side, that is, the nozzles are structured with recording elements of 600 dpi altogether. For the second recording element substrate H1101, three ink supply ports H1102 are arranged on one substrate, and the discharge ports H1107 for cyan, magenta, and yellow are arranged in zigzag for 600 dpi on one side, that is, the recording elements are structured for 1,200 dpi altogether. For the ink jet recording head of the present embodiment, both recording element substrates H1100 and H1101 are mounted on one first plate H1200 in order to arrange the two recording element substrates H1100 and H1101 in extremely high precision for use of black and colors, respectively. Also, the electric contact substrate H2200 and the electric wiring tape H1300, through which electric power and data are supplied from the recording apparatus main body, are arranged to be shared by the two recording element substrates H1100 and H1101 for use, thus reducing the number of components for manufacture at lower costs.

The ink jet recording head of the present embodiment is mounted on the carriage of the recording apparatus main body, and the electric contact provided for the carriage and the electric contact plate H2200 of the ink jet recording head are electrically connected. Both the recording element substrates H1100 and H1101 of the present embodiment are structured to make the discharge amounts different for uses of black and colors, respectively. FIGS. 8A to 8D are views which illustrate the discharge methods of the first recording element substrate and the second recording element substrate. Here, in FIGS. 8A to 8D, the first recording element substrate and the second recording substrate are connected to one and the same power supply source, and each of the structures is arranged on one and same plane (indicated by dotted line).

For the second recording element substrate H1101 of the present embodiment, an ink jet recording method of the so-called bubble through jet type (BTJ type) is adopted in order to perform color printing in a high quality by stabilizing the amount of discharges.

In the case of the usual bubble jet type (BJ type), the distance OH between the discharge port and recording element is relatively long as shown in FIGS. 8A to 8D, and when ink is bubbled by heating of the recording element (electrothermal converting device) H1103, the bubble A is generated in ink I and caused to reside in a state of being enclosed in the ink I. In contrast, in the case of the BTJ type, the distance OH between the discharge port and recording element is relatively short as shown in FIGS. 8A to 8D, and when ink is bubbled by heating of the recording element H1103, ink I Is discharged, while this bubble A is communicated with the outside through the discharge port H1107.

The discharge amount Vd of this BTJ type nozzle is substantially the same as the discharge amount Vd of discharge port area SO×distance (OH) between the discharge port and recording element. For example, given the discharge amount Vd=approximately 5 pl, it should be good enough to set the OH between the discharge port and recording element=25 $\mu$m and the discharge port area SO=200 $\mu m^2$ (diameter$\phi$=approximately 16 $\mu$m).

On the other hand, the ink discharge amount Vd for the first recording element substrate H1100 is set at approximately 30 pl to enable the prints in black ink to look beautiful, and also, to make the printing speed higher. To obtain this discharge amount with the BTJ type, it is necessary to set the discharge port area so=1,200 $\mu m^2$ (diameter$\phi$=approximately 39 $\mu$m) where the distance OH between the discharge port and recording element=25 $\mu$m. If the nozzle is structured in this manner, it Is necessary to use a recording element (electrothermal converting device) H1103 of as large as approximately 35 $\mu$m×35 $\mu$m in order to attain the desired discharge amount. Also, as the discharge port H1107 becomes larger than the recording element H1103, the straight forwardness of discharged liquid droplet is lost. If the distance OH between the discharge port and recording element can be made greater, the discharge port area SO becomes smaller, but in this case, the flow path resistance becomes greater to necessitate the provision of a recording element H1103 which is larger still. This is not favorable from the viewpoint of saving energy. Now, therefore, for the present embodiment, the usual BJ type is adopted for the first recording element substrate H1100 for black use, not the BTJ type. Then, the dimensions thereof is set at the distance OH between the discharge port and recording element=approximately 70 to 80 $\mu$m. and the discharge port area SO=approximately 600 to 800 $\mu m^2$.

In this respect, it is preferable to make the discharge speed 8 m/sec or more in consideration of the satisfactory impact precision and initial discharge characteristics.

Also, it is desirable to make the distance OH between the discharge port and recording element 100 $\mu$m or less in order to satisfy the aforesaid discharge amount and discharge speed.

Figure 9:
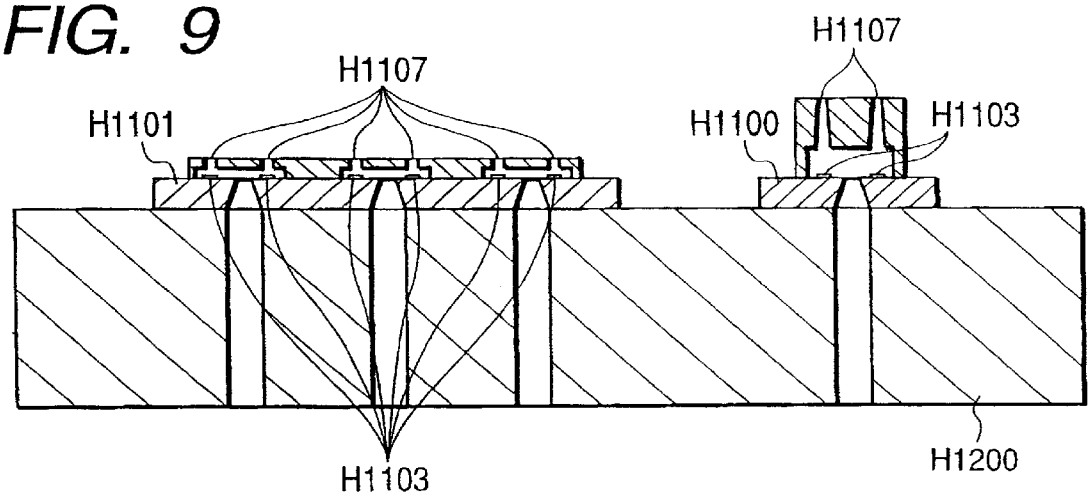
FIG. 9 is an enlarged cross-sectional view which shows the recording element substrate and the first plate in accordance with the first embodiment of the present invention.

Now, as shown in FIG. 9, for the ink jet recording head of the present embodiment, the recording element substrate H1101 of BTJ type for use of color ink and the recording element substrate H1100 of BJ type for use of black ink are mounted on one and the same plate (the first plate H1200). The recording element substrates H1100 and H1101 have different discharge types and ink discharge amounts from each other, and, the applied energy is different to drive each of them.

However, it is arranged to make the supply source voltage the same both for the recording element substrates H1100 and H1101. Here, with only a single supply source needed for the apparatus main body, the costs of manufacture should become lower.

In order to discharge ink of different volumes by the generation of film boiling in ink with the electric current which runs on recording elements H1103 on each of the recording element substrates H1100 and H1101 by the application of the same voltage, the time (pulse width) required to enable electric current to run on the recording elements H1103 is varied to drive them for the ink jet recording head of the present embodiment. For example, in accordance with the present embodiment, the pulse width is approximately 2 $\mu$sec for the recording element for use of black ink, and approximately 0.8 $\mu$sec for the recording element for use of color ink. Here, for the present embodiment, a plurality of driving pulse widths are provided so as not to allow the discharge amounts to be deviated in accordance with the difference of resistance values at which each of the recording elements H1103 is assembled for the recording element substrates H1100 and H1101, and then, driving is made each at such driving pulse widths in accordance with the respective driving pulse width numbers. The driving pulse width number may be determined in accordance with the resistance value of the ink jet recording head to be obtained by the recording apparatus main body or may be determined in such a manner that the resistance values are obtained in the assembling process of an ink jet recording head, which are stored on the ink jet recording head by some appropriate means, and such stored values are read out when the head is installed on a recording apparatus.

Also, in accordance with the present embodiment, when a plurality of recording elements H1103 on the recording element substrates H1100 and H1101 are driven, the flowing current becomes greater, and the voltage drop occurs in the wiring from the recording apparatus main body to the ink jet recording head. As controlling means for preventing the discharge amount from being lowered due to such drop of voltage applied to the recording element substrates H1100 and H1101, it is arranged to change the driving pulse widths in accordance with the number of recording elements H1103 to be driven at a time.

The signals of these pulse width are supplied to from the recording apparatus main body to each of the recording element substrates H1100 and 1101 through the common electric contact substrate H2200 and the electric wiring tape H1300. With the adoption of the structures described above, it becomes possible to provide the recording element substrates H1100 and H1101 having difference driving types with an extremely efficient space arrangement and at lower costs.

(Ink Jet Recording Apparatus)

Figure 19:
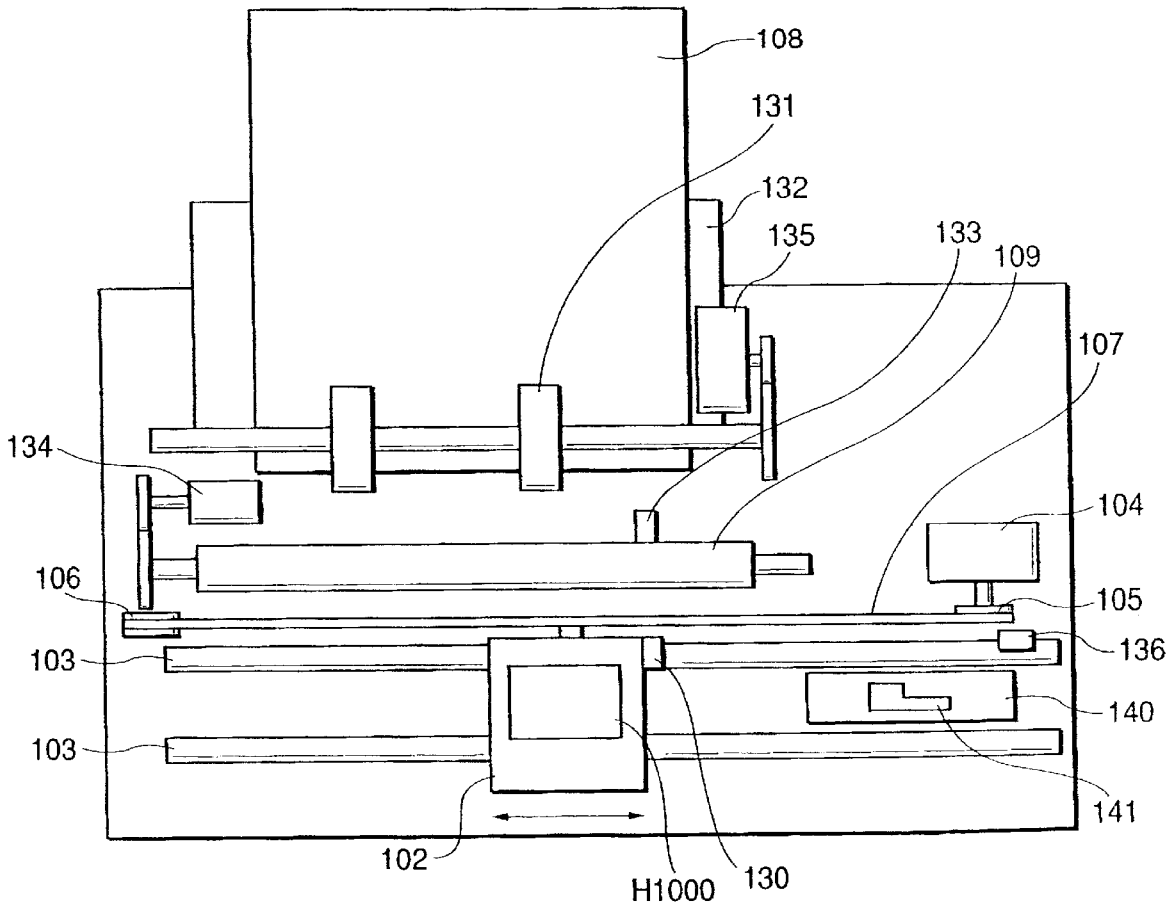
FIG. 19 is a view which illustrates one example of the ink jet recording apparatus in accordance with the present invention.

The description will be made of a liquid discharge recording apparatus capable of mounting thereon a recording head of cartridge type described above. FIG. 19 is a view which illustrates one example of the recording apparatus that can mount thereon the liquid discharge recording head of the present invention.

On the recording apparatus shown in FIG. 19, the recording head cartridge H1000 shown in FIG. 1 is positioned and exchangeably mounted on a carriage 102. For the carriage 102, an electric connector is provided to transmit driving signals and others to each of the discharge portions through the external signal input terminals arranged on the recording head cartridge H1000.

The carriage 102 is supported and guided to be reciprocative along the guide shaft 103 of the apparatus main body, which is arranged to be extended in the main scanning direction. Then, the carriage 102 is driven by a main scanning motor 104 through a motor pulley 105, a driven pulley 106, and a timing belt 107, among some others, while the position and movement thereof is being controlled. Also, a home position sensor 130 is provided for the carriage 102. Thus, when the home position sensor 130 on the carriage 102 passes a sealing plate 136, the position thereof is detected.

The recording medium 108, such as a printing sheet, a thin plastic sheet, is separated fed from an automatic sheet feed (ASF) 132 one by one when a pickup roller 131 rotates by a sheet feeder motor 135 through gears. Further, by the rotation of a conveyance roller 109, it is conveyed (sub-scanned) by way of the position (printing unit) that faces the discharge port surface of the recording head cartridge H1000. The conveyance roller 109 rotates by the rotation of an LF motor 134 through gears. At this juncture, when the recording medium 108 passes over a paper end sensor 133, it is determined whether or not a paper feed is completed to establish the head position thereof at the time of paper feeding. Further, the paper end sensor 133 is used for detecting the trailing end of the recording medium 108, and also, work out the current recording position ultimately on the bases of the actual trailing end.

On the outer side of the paper end sensor 133, that is, outside the recording area, there is provided a cap unit 140 in such a manner to be able to face the discharge port surface of the recording head cartridge H1000. The cap member 141 of the cap unit 140 covers the front side of the discharge ports H1107 of the recording head cartridge H1000 when recording operation is at rest so as to prevent the interior of the discharge ports H1107, as well as around them, from being dried and solidified in order to present the clogging condition which may cause the defective discharges or to receive ink to be discharged when preliminary discharges are performed to compulsorily exhaust bubbles and mixed particles in the discharge ports H1107 and flow paths together with ink when recording operation is at rest. The structure of the cap member 141 will be described later.

In this respect, the reverse side of the recording medium 108 is supported by a platen (not shown) so as form the flat printing surface when the recording medium is in the printing portion. In this case, the discharge port surface of the recording head cartridge H1000 mounted on the carriage 102 protrudes downward from the carriage 102, which is supported between the aforesaid two sets of conveyance roller pair so as to be in parallel to the recording medium 108.

The recording head cartridge H1000 is mounted on the carriage 102 so that the arrangement direction of the discharge ports H1107 in each discharge unit is to intersect the scanning direction of the carriage 102. Then, liquid is discharged from these discharge port arrays for recording.

Next, with reference to FIG. 20 to FIG. 26, the cap member will be described in detail.

Figure 20:
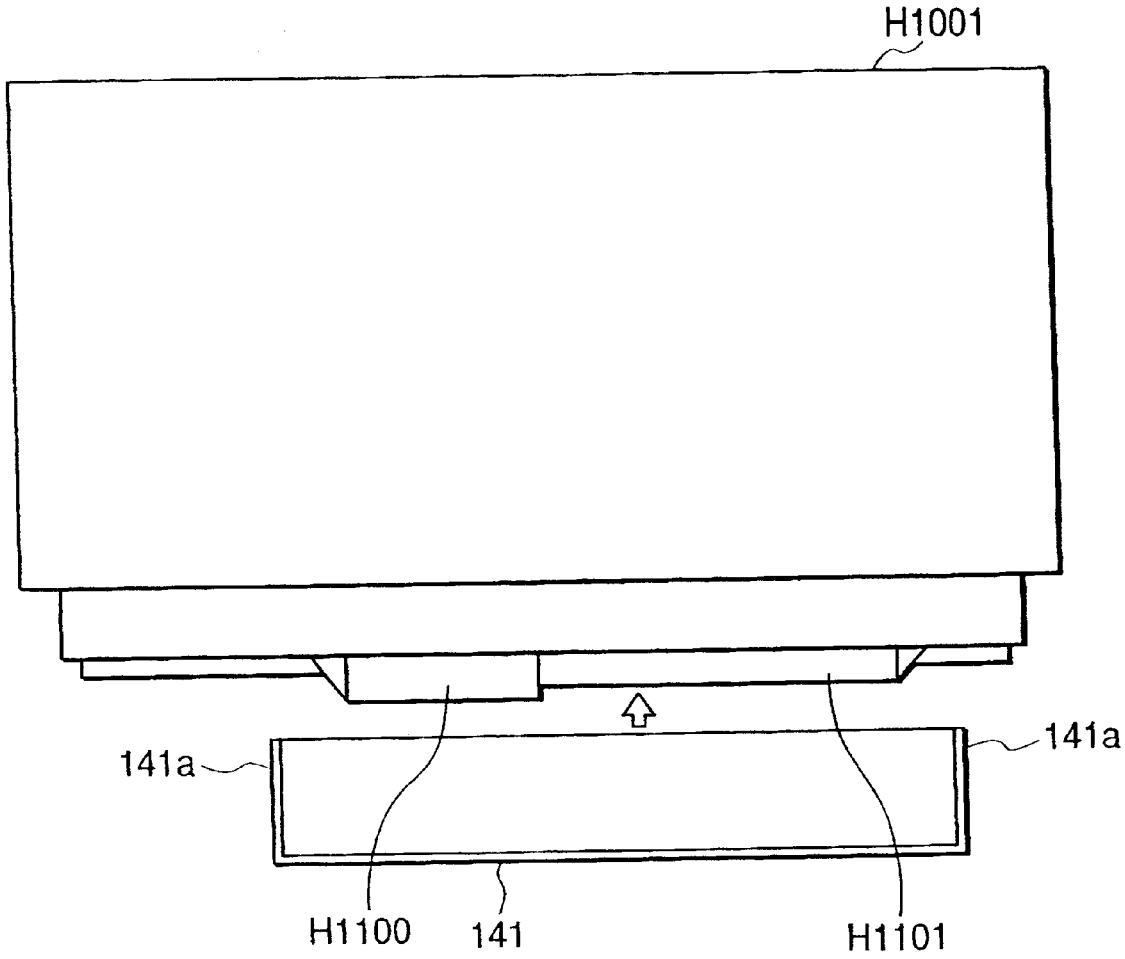
FIG. 20 is view which schematically shows the ink jet recording head and the cap member of the ink jet recording apparatus represented in FIG. 19.
Figure 21:
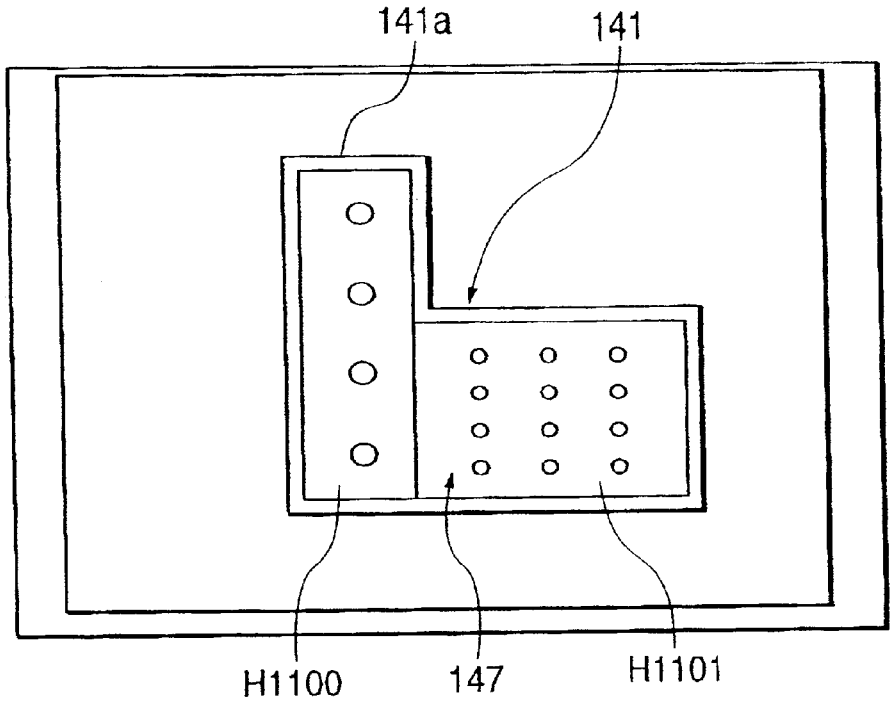
FIG. 21 is a view which schematically shows the state where the ink jet recording head represented in FIG. 20 is capped by the cap member.
Figure 22:
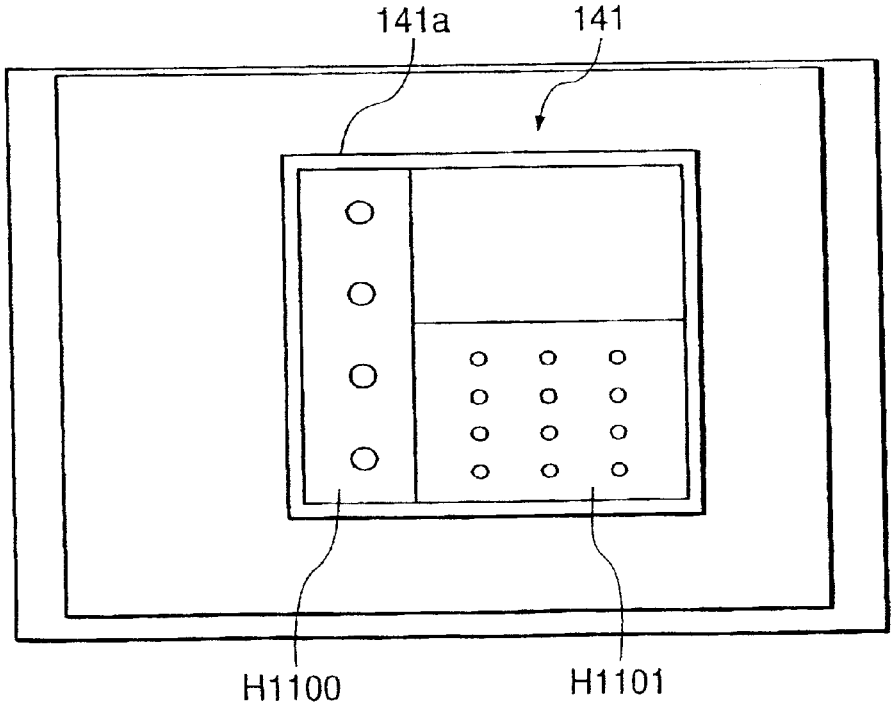
FIG. 22 is a view which schematically shows the state where an ink jet recording head is capped by a cap member in accordance with the variational example thereof.

FIG. 20 schematically shows the outer shape of the ink jet recording head H1001 before being capped. For the present embodiment, the two recording element substrates H1100 and H1101 respectively for use of black ink and color ink are arranged on one and the same plane (substantially even flat plane) of the first plate H1200. As shown in FIG. 9, the thickness of each discharge port formation member of the recording element substrates H1100 and H1101 is different, and the distance between the discharge port and recording element is different, too. The resultant thickness of the entire recording element substrate is different between them. Here, however, one single cap member 141 covers both the recording element substrates H1100 and H1101 altogether. For the cap member 141, one single capping space 147 is formed by use of the ribs 141*a* as shown in FIG. 21. The outer shape of the cap member 141 of the present embodiment corresponds to the recording element substrates H1100 and H1101 as shown in FIG. 21, but it may be possible to form this member in rectangle as shown in FIG. 22.

Figure 23:
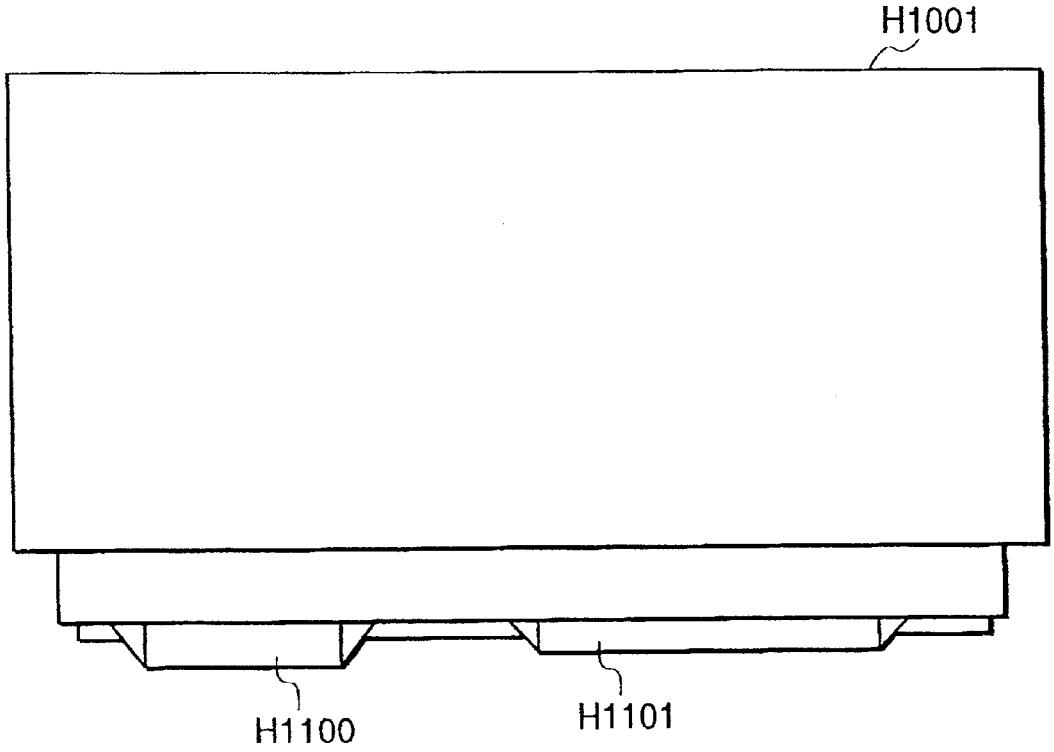
FIG. 23 is a view which schematically shows the ink jet recording heads for which recording element substrates are arranged at a large interval, and two cap members.
Figure 24:
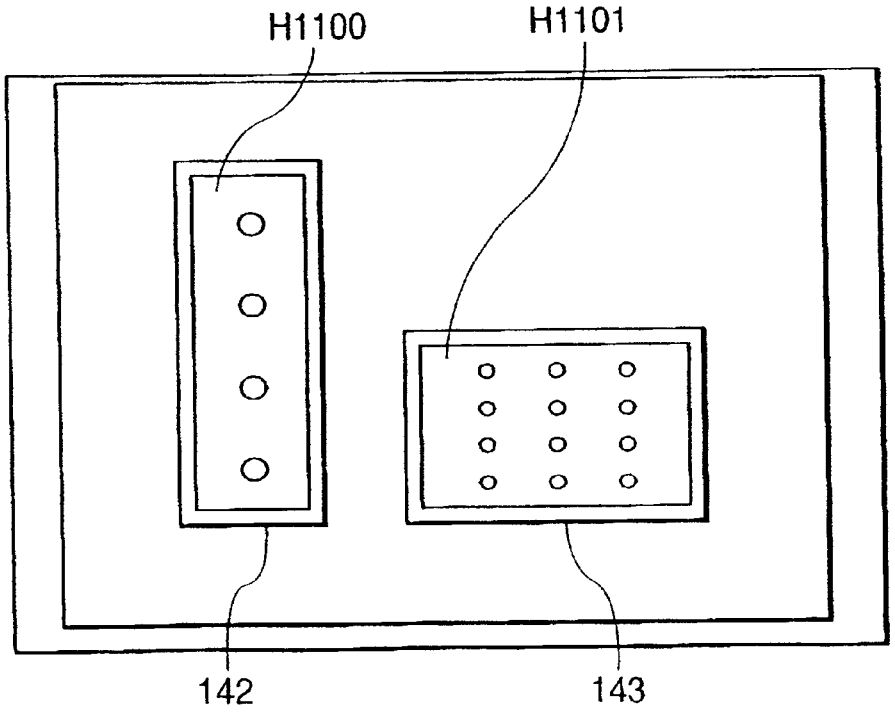
FIG. 24 is a view which schematically shows the state where capping is effectuated by the two cap members for the ink jet recording heads represented in FIG. 23.
Figure 25:
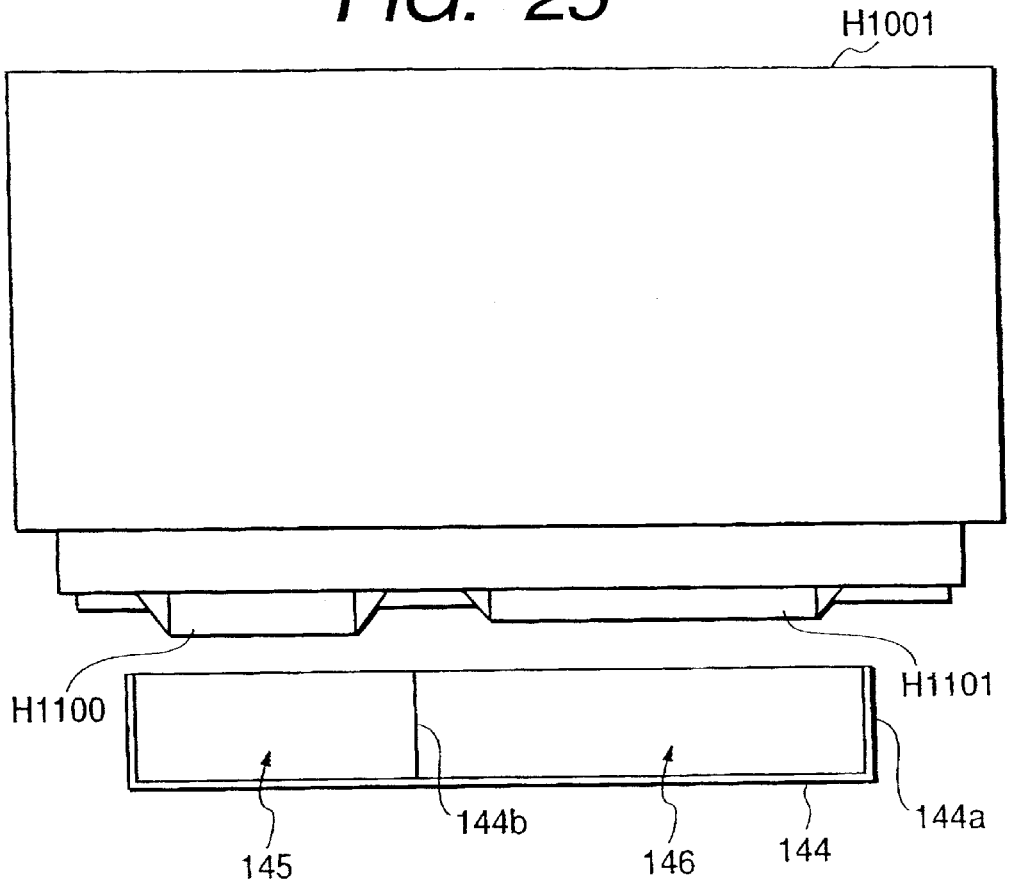
FIG. 25 is a view which schematically shows the ink jet recording heads for which recording element substrates are arranged at a small interval, and two cap members.
Figure 26:
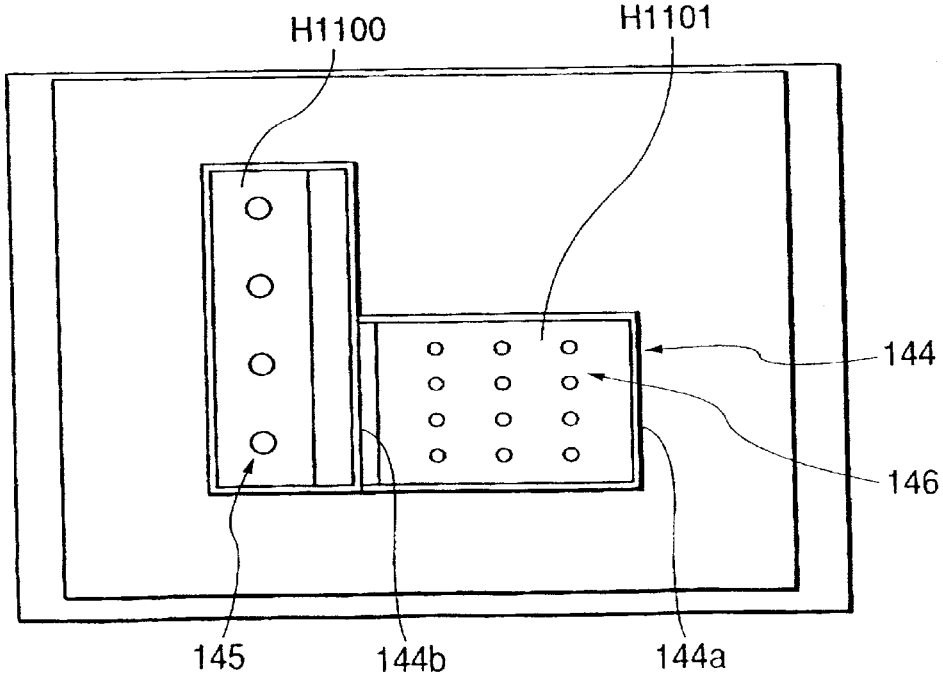
FIG. 26 is a view which schematically shows the state where capping is effectuated by the two cap members for the ink jet recording heads represented in FIG. 25.
Figure 27:
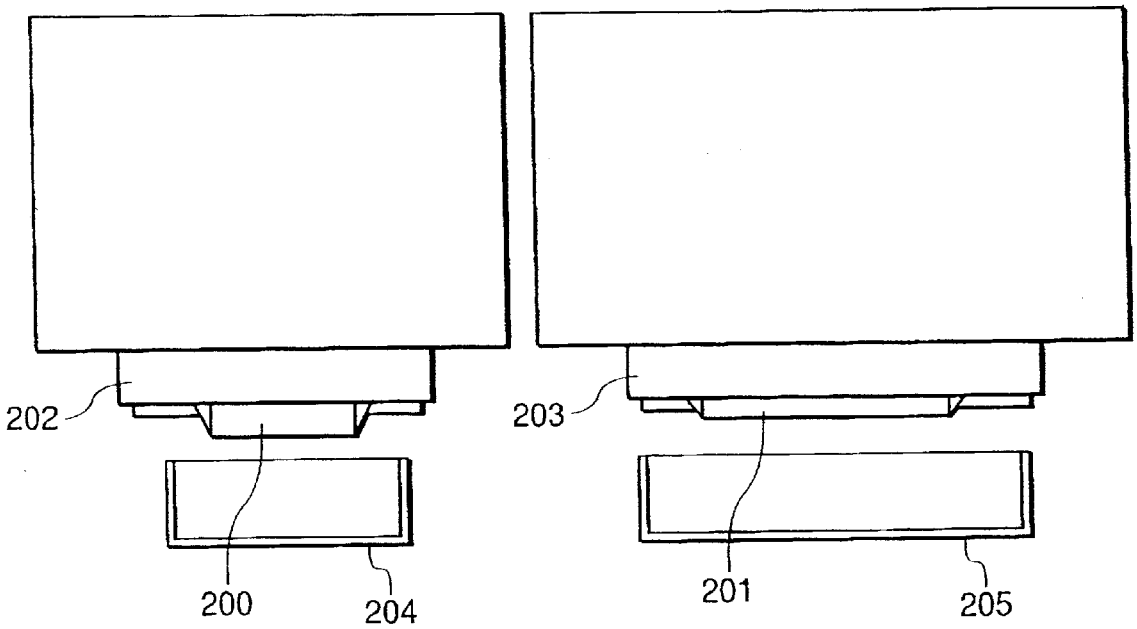
FIG. 27 is a view which schematically shows the conventional ink jet recording heads and two cap members.
Figure 28:
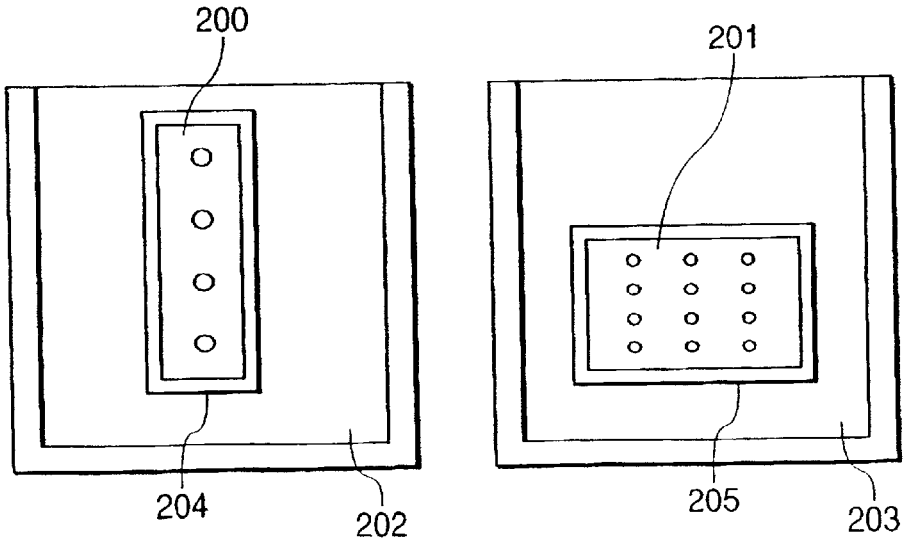
FIG. 28 is a view which schematically shows the ink jet recording heads represented in FIG. 27 are capped by cap members.

In accordance with the present embodiment, the recording element substrates H1100 and H1101 are both positioned on one and the same plate which is uniformly flat (flat surface). Therefore, with the single cap member 141, both the recording element substrates H1100 and H1101 can be capped simultaneously by keeping the ribs 141*a* to be closely in contact with the flat surface. Now, if each of the recording element substrates 200 and 201 should be position on the different surfaces, respectively, as shown in FIG. 27 and FIG. 28, it is extremely difficult to cap them closely by use of a single cap member. However, for the present embodiment, both the recording element substrates H1100 and H1101 are on one and the same flat plane, to make it possible to cap them reliably with ease by use of the single cap member 141, thus producing significant effects on the simplification of structures and the reduction of costs. Also, should there be a large interval between the recording element substrates H1100 and H1101 as shown in FIG. 23, two separated individual cap members 142 and 143 are used for capping them conventionally as shown in FIG. 24. This inevitably invites the structures to be made more complicated at higher costs. In contrast, the recording element substrates H1100 and H1101 of the present embodiment are located adjacent to each other, it is possible to cap them by use of the single cap member 141, while the cap member 141 can be made relatively small. Also, when there is a slight interval between the recording element substrates H1100 and H1101 as shown in FIG. 25, it is possible to enhance the reliability of capping if the ribs 144*a* of the single cap member 144 are formed to provide two capping spaces 145 and 146 so that the discharge ports H1107 of each of the recording element substrates H1100 and H1101 are arranged in each of the capping spaces 145 and 146, respectively, as shown in FIG. 26. The rib 144*b* located at the boundary portion of the capping spaces 145 and 146 is commonly used by the two capping spaces 145 and 146 as a contouring line. As a result, the reliability of capping is enhanced without making the structure very complicated.

Second Embodiment

Here, with reference to FIGS. 17A, 17B, and 17C, and FIG. 18, the description will be made of the parts which differ from those structuring the first embodiment.

Figure 17A:
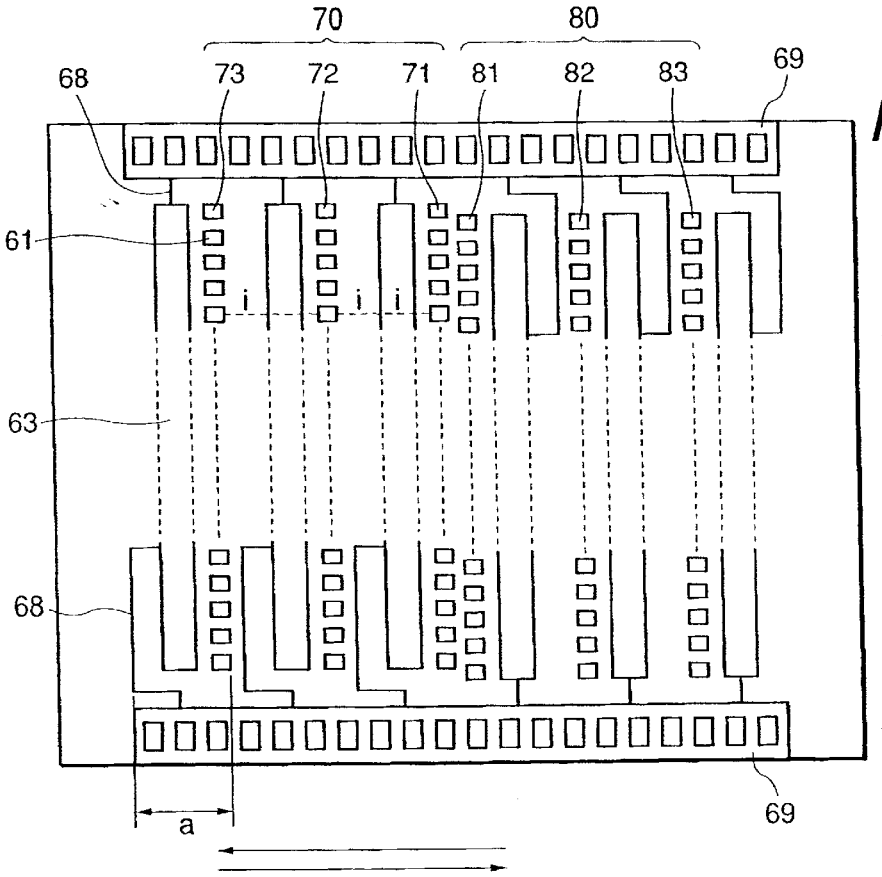
FIGS. 17A, 17B and 17C are views which illustrate the second element substrate in accordance with a second embodiment of the present invention.
Figure 17B:
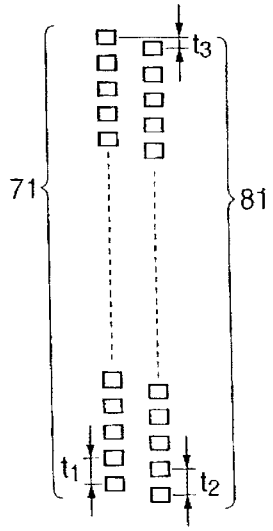
Figure 17C:
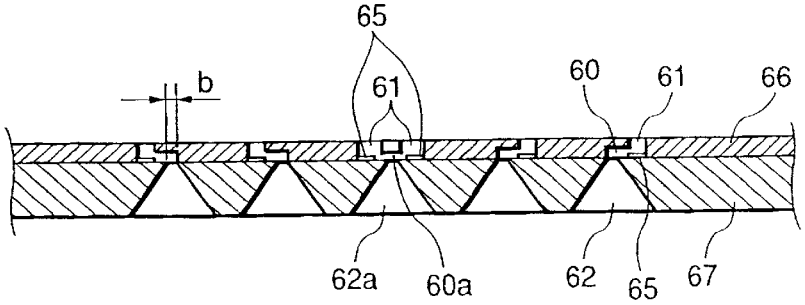
Figure 18:
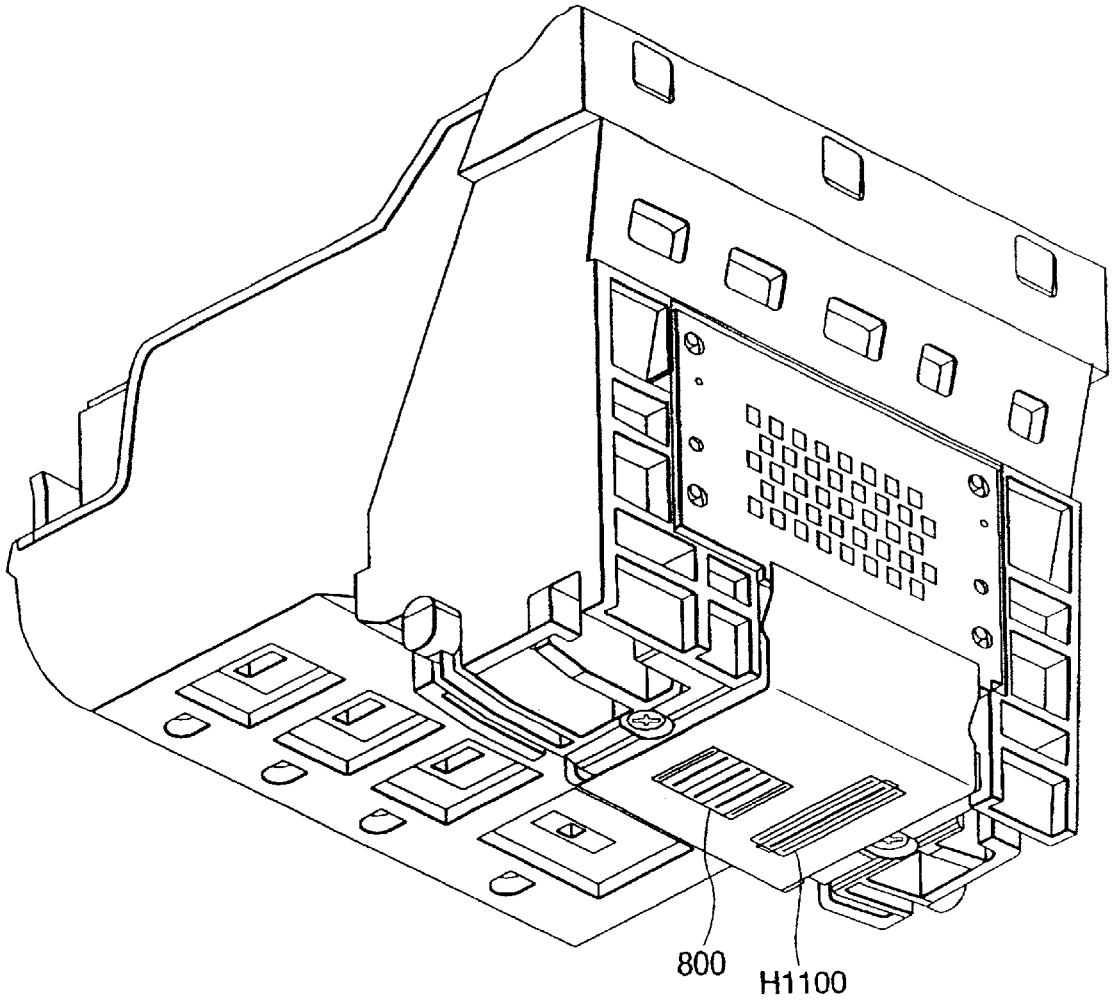
FIG. 18 is a perspective which shows the recording head cartridge which uses the second recording element substrate in accordance with the second embodiment of the present invention.

FIGS. 17A to 17C are views which illustrate the variational example of the second recording element substrate. FIGS. 17A and 17B are front views, and FIG. 17C is a cross-sectional view. FIG. 18 is a view which shows the state where the recording element substrate is incorporated in an ink jet recording head.

As shown typically in FIG. 17C, the second recording element substrate 800 for use of color recording in accordance with the present embodiment comprises a substrate 67 that includes electrothermal converting devices (recording elements) 65 serving as energy converting elements, and an orifice plate 66 that forms discharge ports 61. The substrate 67 is formed by silicon the monocrystal which provides surface orientation of <100>, and on the substrate 67, there are formed by use of semiconductor process a plurality of electrothermal converting device 65 lines; the driving circuits 63 that drives each line of electrothermal converting devices 65; contact pads 69 for external connection; and wiring 68 for connecting the driving circuit 63 and the contact pads 69, among some others. Also, for the substrate 67, there are provided five through openings formed by means of anisotropic etching on the area excluding the aforesaid driving circuit 63, electrothermal converting devices 65, the wiring 68, and the like, and also, formed the ink supply ports 62 and 62*a* to supply liquid to each of the discharge port arrays 71 to 73, and 81 to 83, respectively. Here, FIG. 17A schematically shows the state where the orifice plate 66 which is almost transparent is formed on the substrate 67 with the omission of the aforesaid electrothermal converting devices and ink supply ports in the representation thereof.

The orifice plate 66 arranged on the substrate 67 is formed by photosensitive epoxy resin, and the discharge ports 61 and the liquid flow paths 60 are formed corresponding to the aforesaid electrothermal converting devices 65.

Also, the recording element substrate 800 can receive driving signals and others from the recording apparatus when the external signal input terminals, which are connected with the wiring plate, are in contact with the electric connector of the recording apparatus through the contact pads 69 being coupled with the electric terminals of the electric wiring tape. Further, the ink supply ports 62 and 62*a* are communicated with ink tanks of each color through the ink flow paths of the flow path formation member H1600 of the ink supply unit.

Also, in accordance with the present embodiment, a plurality of discharge ports are provided and arranged at specific pitches, respectively. Then, the discharge port arrays (discharge port units) 71 to 73, and 81 to 83 are formed substantially in parallel to each other. Here, in FIG. 17A, the ith discharge ports of discharge port arrays 71 to 73, positioned from the upper part of FIG. 17A, are identical in the direction indicated by arrows in FIG. 17A. In this manner, the discharge port arrays 71 to 73 are arranged so the each of the discharge ports corresponds to each other in the scanning direction when the recording head is mounted on the recording apparatus or the like to scan. Thus, the first discharge port array group 70 is formed. The discharge port arrays 81 to 83 are also arranged in the same manner as the discharge port arrays 71 to 73, and the second discharge port array group 80 is formed by the discharge port arrays 81 to 83 adjacent to the first discharge port array group 70.

For the second recording element substrate 800, five ink supply ports are arranged on one substrate. There are arranged nozzles for use of cyan ink on one side, nozzles for use of magenta ink on one side, nozzles for use of yellow ink on both sides, nozzles for use of magenta ink on one side, and nozzles for use of cyan ink in that order. The structure is arranged to provide recording elements of 1,200 dpi, 600 dpi arranged in zigzag each on one side.

In other words, for the six discharge port arrays formed by two discharge port array groups, the discharge port array 73 and 83 on the outermost side are arranged to discharge cyan (C); discharge port arrays 72 and 82, magenta (M); and the discharge port arrays 71 and 81 adjacent to each on the innermost side, yellow (Y). Therefore, to the ink supply port 62*a* (ink supply port arranged on the central portion) yellow ink is supplied; to the two ink supply ports 62 adjacent to the ink supply port 62*a*, magenta ink; and to the two ink supply port 62 on the outermost side, cyan ink from each individual ink tank of Y, M, C, respectively. In this manner, the central ink supply port 62*a* supplies liquid to the two discharge port arrays 71 and 81, and the ink supply port 62*a* and the liquid flow path 60*a* function as a common liquid chamber portion for the tow discharge port arrays 71 and 81.

As described above, the discharge port arrays that discharge the same kinds of liquid are arranged on the portion adjacent to the two discharge port array groups, respectively, and with this portion on the center, the discharge port arrays of the other same kinds and driving circuits are arranged symmetrically. Thus, the through openings that serve as the ink supply ports 62 and 62*a*, the driving circuits, the electrothermal converting devices, and others are arranged on the substrate at the same intervals without any waste to make the size of the substrate small. Further, with the symmetrical arrangement of the discharge port arrays that discharge the same kind of liquid, the order of ink shooting (discharging) per pixel for the formation of a desired color on a recording medium becomes the same in the forward scan and the backward scan when a reciprocating recording (bidirectional printing) is performed, hence making it possible to make coloring uniform in the scanning directions and prevent the generation of color unevenness in the reciprocation of printing.

Further, as clear from FIGS. 17A and 17B, the first discharge port array group 70 and the second discharge port array group 80 are arranged at the pitches of discharge port arrangement in such a way to shift each of them by a ½ pitch in the sub-scanning direction of the recording head (identical to the arrangement direction of the discharge port arrays in the case of the present embodiment) so that each of the discharge ports of the discharge port arrays 71 to 73 and 81 to 83 which form each of the discharge port groups complement each other in the aforesaid scanning direction. In this manner, it becomes possible to perform the highly precise printing which is substantially even two time the arrangement pitches of discharge ports.

Further, for the second recording element substrate 800, the arrangement density of the electrothermal converting devices 65 is set at 1,200 dpi and the amount of color liquid droplet at 4 to 8 pl. On the other hand, the arrangement density of the electrothermal converting devices is set at 600 dpi for the recording element substrate H1100 described in conjunction with the first embodiment, and the amount of black liquid droplet, 20 to 40 pl. As a result, the size of each electrothermal converting device 65 of the second recording element substrate 800 is smaller than that of the electrothermal converting device for use of black ink of the first recording element substrate H1100. Also, the size of each discharge port 61 is smaller than that of the discharge port of the first recording element substrate H1100. For example, in order to obtain a black liquid droplet of 30 pl, the distance OH between the discharge port and electrothermal converting device of the first recording element substrate H1100 should be 70 to 80 $\mu$m, and the discharge port area SO, 600 to 800 $\mu^2$. On the other hand, in order to obtain a color droplet of 5 pl, the OH of the second recording element substrate 800 should be 25 $\mu$m and the SO, 200 $\mu m^2$. Here, the conditions are the same as those described above with respect to the first embodiment.

In accordance with the present embodiment, the structure of the second recording element substrate 800 thus structured, and the first recording element substrate H1100 described in the first embodiment are bonded and fixed on the first plate H1300, and the recording head cartridge (see FIG. 18) is assembled with the same structure as described in the first embodiment.

Also, the arrangement density of electrothermal converting devices on the second recording element substrate 800 for color use is made two times that of electrothermal converting devices on the first recording element substrate H1100 (for example, the density is 600 dpi for the electrothermal converting devices on the first element substrate H1100, and the density is made 1,200 dpi for those on the second substrate 800). With this arrangement, it becomes possible to secure the heating pulse width of approximately 2.5 $\mu$s even if 16 time-division driving is performed at 25 KHz. The pulse width is suppressed to be approximately 2 $\mu$s even if correction is made per usual one $\mu$s pulse width for the varied resistance value of electrothermal converting device at the time of manufacture, as well as the voltage drop caused by the discharge current. It has been ascertained that there is no problem in using the electrothermal converting device up to $10^9$ pulse. In contrast, when the density of electrothermal converting devices on the second recording element substrate 800 is arranged to be equal to that of those on the first recording element substrate H1100, it is needed to drive them at 50 KHz in order to obtain the same recording speed, and the pulse width must be suppressed to 1.25 $\mu$s or less. In this case, the voltage must be increased for use, because it is impossible to make nay sufficient correction by means of the aforesaid pulse width. As a result, the electrothermal converting device is broken at $10^7$ pulse. In the present embodiment, too, as in the case of the first embodiment, the height of the discharge port surface of the first recording element substrate H1100 and that of the second element substrate 800 are different with the reverse side of the first plate H1200 as reference. In other words, the discharge port surface of the first recording element substrate H1100 for use of monochrome recording is higher from the reference plane than the discharge port surface of the second recording element substrate 800 for use of color recording.

What is claimed is:

1. An ink jet recording apparatus comprising:

an ink jet recording head provided with a plurality of recording element substrates respectively having a plurality of recording elements for generating energy to be utilized for discharging ink, a plurality of flow paths for retaining ink to receive said energy, and a plurality of ink discharge ports for discharging ink; and a cap member for capping the discharge ports of said ink jet recording head, wherein among said plurality of recording element substrates, the thickness of one recording element substrate thereof is different from that of the other recording element substrate and said plurality of recording element substrates are arranged adjacent to each other on a substantially flat plane, and said cap member is capable of capping said discharge ports of said plurality of recording element substrates collectively on said substantially flat plane or on another substantially flat plane.

2. An ink jet recording apparatus according to claim 1, wherein the distance between said recording element and said discharge port on said one recording element substrate is different from the distance between said recording element and said discharge port on said other recording element substrate.

3. An ink jet recording apparatus according to claim 1, wherein the liquid discharge type of said recording element on said one recording element substrate is different from the liquid discharge type of said recording element on said other recording element substrate.

4. An ink jet recording apparatus according to claim 1, wherein said cap member performs capping with the ribs thereof being closely in contact with said other flat plane.

5. An ink jet recording apparatus according to claim 4, wherein said ribs of said cap member forms a single capping space being surrounded thereby to perform capping by positioning said discharge ports of said plurality of recording element substrates in said single capping space.

6. An ink jet recording apparatus according to claim 4, wherein a plurality of capping spaces are formed by being surrounded by said ribs of said cap member, and said discharge ports of said recording element substrates are positioned respectively in said plurality of capping spaces to perform capping.

7. An ink jet recording apparatus according to claim 6, wherein at least a part of said ribs positioned at the boundary of said plurality of capping spaces is made to be an contour line commonly possessed by said plurality of capping spaces.

8. An ink jet recording apparatus according to claim 1, wherein the distance between said recording element and said discharge port on said recording substrate having color liquid being supplied thereto as ink is shorter than the distance between said recording element and said discharge port on said recording substrate having black liquid being supplied thereto as ink.

9. An ink jet recording apparatus according to claim 8, wherein the discharge amount of liquid discharged from said discharge port on said recording element substrate having color liquid being supplied thereto as ink is smaller than the discharge amount of liquid discharged from said discharge port on said recording element substrate having black liquid being supplied thereto as ink.

10. An ink jet recording apparatus according to claim 8, wherein the liquid discharge method of said recording element on said recording element substrate having black liquid being supplied thereto as ink generates a bubble in ink by action of said recording element, and extinguishes bubble generation by disappearing said bubble formed by said bubble generation, and the liquid discharge method of said recording element on said recording element substrate having color liquid being supplied thereto as ink enables the bubble formed by said bubble generation to be communicated with the outside through said discharge port when the bubble is generated in ink by action of said recording element.

11. An ink jet recording apparatus according to claim 1, wherein said plurality of recording element substrates are provided with the substrates of substantially the same thickness arranged on one and the same plane, and discharge port formation members laminated on said substrates, and then, the distance between said recording element and said discharge port of at least one of said recording element substrate is different owing to the different height of said discharge port formation member thereof from that of said other recording element substrate.

12. An ink jet recording apparatus according to claim 1, further comprising a plurality of ink tanks for supplying ink to said plurality of recording element substrates.

13. An ink jet recording apparatus according to claim 1, wherein electric energy is supplied to said plurality of recording elements of said plurality of recording element substrates from a common supply source.

14. An ink jet recording apparatus according to claim 1, wherein said plurality of recording element substrates are assembled on a common base member.

15. An ink jet recording apparatus according to claim 1, wherein said recording element generates thermal energy.

* * * * *

UNITED STATES PATENT AND TRADEMARK OFFICE

CERTIFICATE OF CORRECTION

PATENT NO. : 6,663,217 B2
DATED : December 16, 2003
INVENTOR(S) : Otsuka et al.

It is certified that error appears in the above-identified patent and that said Letters Patent is hereby corrected as shown below:

Title page,
Item [56], References Cited, FOREIGN PATENT DOCUMENTS, “06191061” should read -- 6-191061 --.

Column 1,
Line 33, “process,” should read -- processor, --.

Column 4,
Line 31, “forms” should read -- form --.

Column 5,
Line 18, “from” should read -- from --;
Line 26, “arranged” should read -- arranged in --; and
Line 57, “FIG. 5 exploded” should read -- FIG. 5 shows exploded --.

Column 9,
Line 51, “like” should read -- like, --.

Column 14,
Line 61, “plate” should read -- place --.

Column 15,
Line 50, “from” should read -- form --.

Column 17,
Line 44, “so” should read -- SO --.

Signed and Sealed this

Tenth Day of August, 2004

JON W. DUDAS
*Acting Director of the United States Patent and Trademark Office*